US010131965B2

(12) United States Patent
Monden et al.

(10) Patent No.: US 10,131,965 B2
(45) Date of Patent: Nov. 20, 2018

(54) STEEL BAR

(71) Applicant: NIPPON STEEL & SUMITOMO METAL CORPORATION, Tokyo (JP)

(72) Inventors: Atsushi Monden, Hokkaido (JP); Shunta Homma, Narashino (JP); Koichi Banno, Hokkaido (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 170 days.

(21) Appl. No.: 15/032,496

(22) PCT Filed: Nov. 18, 2014

(86) PCT No.: PCT/JP2014/080452
§ 371 (c)(1),
(2) Date: Apr. 27, 2016

(87) PCT Pub. No.: WO2015/076242
PCT Pub. Date: May 28, 2015

(65) Prior Publication Data

US 2016/0273067 A1 Sep. 22, 2016

(30) Foreign Application Priority Data

Nov. 19, 2013 (JP) ..... 2013-239038

(51) Int. Cl.
*C21D 9/52* (2006.01)
*C21D 8/06* (2006.01)
(Continued)

(52) U.S. Cl.
CPC ..... *C21D 9/525* (2013.01); *C21D 1/06* (2013.01); *C21D 3/04* (2013.01); *C21D 8/06* (2013.01);
(Continued)

(58) Field of Classification Search
CPC ..... C22C 38/00; C22C 38/001; C22C 38/002; C22C 38/005; C22C 38/008; C22C 38/02;
(Continued)

(56) References Cited

U.S. PATENT DOCUMENTS

| | | | |
|---|---|---|---|
| 4,786,338 | A | 11/1988 | Anzawa et al. |
| 2012/0279616 | A1 | 11/2012 | Miyanishi et al. |
| 2013/0098513 | A1 | 4/2013 | Lee et al. |

FOREIGN PATENT DOCUMENTS

| | | | |
|---|---|---|---|
| CN | 102661969 | A | 9/2012 |
| EP | 1 243 664 | A1 | 9/2002 |

(Continued)

OTHER PUBLICATIONS

Extended European Search Report dated May 17, 2017, in European Patent Application No. 14863197.1.

(Continued)

*Primary Examiner* — Keith Walker
*Assistant Examiner* — John A Hevey
(74) *Attorney, Agent, or Firm* — Birch, Stewart, Kolasch & Birch, LLP

(57) ABSTRACT

A steel bar according to one embodiment of the present invention includes predetermined chemical composition, wherein a quenching deflection in a cross section is 1.5 mm or less, wherein Δmax and Δmin is 1.5 mm or less, wherein a structure in a surface layer area includes 10 area % or less of ferrite and a remainder including one or more selected from a group consisting of a bainite and a martensite, wherein an average value of the grain size of a bcc phase in the surface layer area is 1.0 to 10.0 μm, wherein an average value of the grain size of the bcc phase in a center area is 1.0 to 15.0 μm, wherein a hardness of a region of which a depth
(Continued)

from the surface is 50 μm is Hv200 to Hv500, and wherein a total decarburized layer thickness DM-T is 0.20 mm or less.

16 Claims, 5 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/22*** | (2006.01) |
| ***C21D 1/06*** | (2006.01) |
| ***C21D 3/04*** | (2006.01) |
| ***C22C 38/60*** | (2006.01) |

(52) U.S. Cl.
CPC ..... *C21D 8/065* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/60* (2013.01); *C21D 9/52* (2013.01); *C21D 2211/002* (2013.01); *C21D 2211/005* (2013.01); *C21D 2211/008* (2013.01)

(58) Field of Classification Search
CPC ..... C22C 38/04; C22C 38/06; C22C 38/08; C22C 38/12; C22C 38/14; C22C 38/16; C22C 38/18; C22C 38/22; C22C 38/60; C21D 1/06; C21D 3/04; C21D 9/52; C21D 9/525; C21D 8/065; C21D 8/06; C21D 2211/002; C21D 2211/005; C21D 2211/008
See application file for complete search history.

(56) References Cited

FOREIGN PATENT DOCUMENTS

| | | | | |
|---|---|---|---|---|
| EP | 1243664 | A1 * | 9/2002 | ..... C21D 1/32 |
| JP | 60-141832 | A | 7/1985 | |
| JP | 61-48521 | A | 3/1986 | |
| JP | 62-13523 | A | 1/1987 | |
| JP | 62-103323 | A | 5/1987 | |
| JP | 64-39324 | A | 2/1989 | |
| JP | 2-213415 | A | 8/1990 | |
| JP | 2-259014 | A | 10/1990 | |
| JP | 5-9705 | U | 2/1993 | |
| JP | 5-115914 | A | 5/1993 | |
| JP | 6-136441 | A | 5/1994 | |
| JP | 2001-240941 | A | 9/2001 | |
| JP | 3288583 | B2 | 3/2002 | |
| JP | 2010-168624 | A | 8/2010 | |
| JP | 2013-133519 | A | 7/2013 | |
| JP | 2013-533384 | A | 8/2013 | |
| JP | 2013-234349 | A | 11/2013 | |
| WO | WO 2013/151009 | A1 | 10/2013 | |

OTHER PUBLICATIONS

Notification of the First Office Action dated Dec. 23, 2016, in Chinese Patent Application No. 201480062740.6, with English translation.
International Search Report for PCT/JP2014/080452 dated Feb. 24, 2015.
Written Opinion of the International Searching Authority for PCT/JP2014/080452 (PCT/ISA/237) dated Feb. 24, 2015.
Notice of Preliminary Rejection dated Feb. 21, 2017, in Korean Patent Application No. 10-2016-7012820, with English translation.

* cited by examiner

STEEL BAR

TECHNICAL FIELD

The present invention relates to a hot-rolled and direct-quenched steel bar for induction hardening.

Priority is claimed on Japanese Patent Application No. 2013-239038, filed at Nov. 19, 2013, the content of which is incorporated herein by reference.

BACKGROUND ART

Components for machine structures used for machines such as vehicles, construction machines, and the like (more specifically, steering components for a vehicle, drive shafts, chassis parts, and the like) are manufactured by cutting a steel bar so as to form the shape of a part. After forming the part shape, a component for a machine structure which requires strength and toughness is quenched and tempered (i.e. thermal refining) to ensure the strength and the toughness needed thereby. However, in order to decrease manufacturing costs for the parts and in order to protect the environment, there is demand for a process that omits heat treatment which consumes a huge amount of energy in recent years. Therefore, there is also demand for a process that omits the quenching and the tempering, i.e., the thermal refining process. It is considered that one way to omit the thermal refining process is to in-line quench a steel bar immediately after hot-rolling to be used as the material for a component of a machine structure and reheat the steel bar with sensible heat of the central part of the steel bar (i.e. self-tempering). However, if the quenching and the tempering are performed with the reheating, the hardening depth becomes uneven. If the hardening depth becomes uneven, warpage occurs in the steel bar. If a marked warpage occurs, it is necessary to correct the warpage and yield decreases due to shape failure, and thus, such marked warpage decreases production efficiency of the steel bar. In order to keep the production efficiency of the steel bar at a level preferable for industrial use, the amount of the warpage in the steel bar should be limited to less than 3 mm/m.

In the prior art of the steel bar, for example, a method in which a steel is directly quenched and tempered just after hot-rolling is disclosed in patent documents 1 to 7. However, patent document 1 relates to a rod mill round bar and does not consider induction hardenability. Patent document 2 proposes a method for enhancing the structure of a surface layer part of the steel by controlling the amount of cooling water. However, in the technique disclosed in the patent document 2, evenness of the hardening depth is not considered. The patent document 3 relates to a steel including 0.05 to 0.3% of C. The amount of C is insufficient for applying the induction hardening thereto as surface layer hardening treatment. Therefore, the steel disclosed in the patent document 3 does not have sufficient induction hardenability. Patent document 4 proposes a steel bar in which a surface layer part which is from the surface to a depth of 2 mm is controlled to be a sorbite structure and inner structure is controlled to be a ferrite and pearlite structure by direct quenching after hot working and self-tempering. However, in patent document 4, evenness of the hardening depth is not considered. The patent documents 5 to 7 disclose method for manufacturing, in which hot-rolling is performed during ferrite-austenite coexisting state (so called "dual phase rolling"). However, decarburizing easily occurs in steel obtained by the hot-rolling, and thus, induction hardenability of the steel disclosed in the patent documents 5 to 7 is insufficient.

PRIOR ART DOCUMENTS

Patent Documents

[Patent Document 1] Japanese unexamined patent application, First Publication No. S60-141832

[Patent Document 2] Japanese unexamined patent application, First Publication No. S62-103323

[Patent Document 3] Japanese unexamined patent application, First Publication No. S62-013523

[Patent Document 4] Japanese unexamined patent application, First Publication No. H1-039324

[Patent Document 5] Japanese unexamined patent application, First Publication No. S61-048521

[Patent Document 6] Japanese unexamined patent application, First Publication No. H2-213415

[Patent Document 7] Japanese unexamined patent application, First Publication No. 2010-168624

SUMMARY OF INVENTION

Technical Problem

In view of the above, the object of the present invention is to provide a hot-rolled and directly-quenched steel bar for induction hardening, and to provide a steel bar which is a medium carbon steel; has excellent crack propagation stopping properties and excellent low temperature toughness; has excellent induction hardenability and excellent machinability; has uniform hardening depth; is manufactured by a method which does not include a thermal refining process; and has high productivity.

Method for Solving the Problem

The inventors have conducted research to solve the above-described problems. As a result, the inventors found that it is necessary to control the composition of the steel bar as well as optimize the method for manufacturing thereof to enhance crack propagation stopping properties, low temperature toughness, productivity, and induction hardenability of the hot-rolled and directly-quenched steel bar for induction hardening, which is a medium carbon steel. In particular, the inventors found that adequately controlling the heating temperature and heating time before hot-rolling; controlling the hot-rolling temperature (especially, finish rolling temperature); controlling the flow velocity of cooling water to obtain a structure in which the bcc phase is fine and the total decarburization is low; adequately controlling water film thickness of the cooling water and the reheating temperature to suppress unevenness of the structure of the steel bar in the circumferential and longitudinal directions in order to provide adequate hardness to the steel bar are useful. In the present invention, "a steel bar of which induction hardenability is enhanced" indicates a steel bar in which the structure has a predetermined hardness corresponding to the amount of carbon and unevenness of hardness, and the structure of the steel bar is small after induction hardening.

The present invention was achieved based on the above-described novel findings, and a summary of the present invention is as follows.

(1) A steel bar according to one embodiment of the present invention includes, as a chemical composition in terms of mass %: C: 0.30 to 0.80%; Si: 0.01 to 1.50%; Mn: 0.05 to 2.50%; Al: 0.010 to 0.30%; N: 0.0040 to 0.030%; P: 0.035% or less; S: 0.10% or less; Cr: 0 to 3.0%; Mo: 0 to 1.5%; Cu: 0 to 2.0%; Ni: 0 to 5.0%; B: 0 to 0.0035%; Ca: 0 to 0.0050%; Zr: 0 to 0.0050%; Mg: 0 to 0.0050%; Rem: 0 to 0.0150%; Ti: 0 to 0.150%; Nb: 0 to 0.150%; V: 0 to 1.0%; W: 0 to 1.0%; Sb: 0 to 0.0150%; Sn: 0 to 2.0%; Zn: 0 to 0.50%; Te: 0 to 0.20%; Bi: 0 to 0.50%; Pb: 0 to 0.50%, and a remainder including Fe and impurities, wherein a region which is along a line extending between a center of a cross section of the steel bar and a periphery of the cross section of the steel bar and which has a hardness higher than the average hardness in the line by Hv20 or more is a hardening region in the line, the minimum value of depth of the hardening regions in the 8 lines of which the angle is 45° is the minimum hardening depth in the cross section, and the maximum value of the depth of the hardening regions in the 8 lines is the maximum hardening depth in the cross section, wherein the difference between the maximum hardening depth in the cross section and the minimum hardening depth in the cross section is 1.5 mm or less, wherein the difference between the maximum value of the maximum hardening depth and the minimum value of the maximum hardening depth in the cross sections at 3 points which are separated from each other by 1650 mm parallel to a longitudinal direction of the steel bar is 1.5 mm or less, wherein the difference between the maximum value of the minimum hardening depth and the minimum value of the minimum hardening depth in the cross sections at the 3 points which are separated from each other by 1650 mm parallel to the longitudinal direction of the steel bar is 1.5 mm or less, wherein a structure in an area from a surface of the steel bar to a depth of 25% of a radius of the steel bar includes 10 area % or less of a ferrite and a remainder including one or more selected from a group consisting of a bainite and a martensite, wherein a boundary between grains which are adjacent to each other and of which an orientation difference is 15 degree or more is a grain boundary, and an equivalent circle diameter of an area surrounded by the grain boundary is a grain size, wherein the average value of the grain size of a bcc phase in the area from the surface of the steel bar to the depth of 25% of the radius of the steel bar is 1.0 to 10.0 μm, wherein the average value of the grain size of the bcc phase in an area from the depth of 50% of the radius of the steel bar to the center of the steel bar is 1.0 to 15.0 μm, wherein a hardness of a region of which a depth from the surface is 50 μm is Hv200 to Hv500, and wherein a total decarburized layer thickness DM-T is 0.20 mm or less.

(2) The steel bar according to (1) may include, as the chemical composition in terms of mass %: one or more selected from the group consisting of Cr: 0.1 to 3.0%; Mo: 0.10 to 1.5%; Cu: 0.10 to 2.0%; Ni: 0.1 to 5.0%; and B: 0.0010 to 0.0035%.

(3) The steel bar according to (1) or (2) may include, as the chemical composition in terms of mass %: one or more selected from the group consisting of Ca: 0.0001 to 0.0050%; Zr: 0.0003 to 0.0050%; Mg: 0.0003 to 0.0050%; and Rem: 0.0001 to 0.0150%.

(4) The steel bar according to any one of (1) to (3) may include, as the chemical composition in terms of mass %: one or more selected from the group consisting of Ti: 0.0030 to 0.0150%; Nb: 0.004 to 0.150%; V: 0.03 to 1.0%; and W: 0.01 to 1.0%.

(5) The steel bar according to any one of (1) to (4) may include, as the chemical composition in terms of mass %: one or more selected from the group consisting of Sb: 0.0005 to 0.0150%; Sn: 0.005 to 2.0%; Zn: 0.0005 to 0.50%; Te: 0.0003 to 0.20%; Bi: 0.005 to 0.50%; and Pb: 0.005 to 0.50%.

Advantageous Effects of Invention

Hot-rolled and directly-quenched steel bar for induction hardening according to the above-described embodiments has high crack propagation stopping properties, and the base material has low temperature toughness. Further, the unevenness of the hardening depth after hot-rolling of the steel bar is small, even if thermal refining is not performed. Therefore, the present invention can obtain a steel bar which is excellent in productivity and induction hardenability.

DESCRIPTION OF EMBODIMENTS

Figure 1:
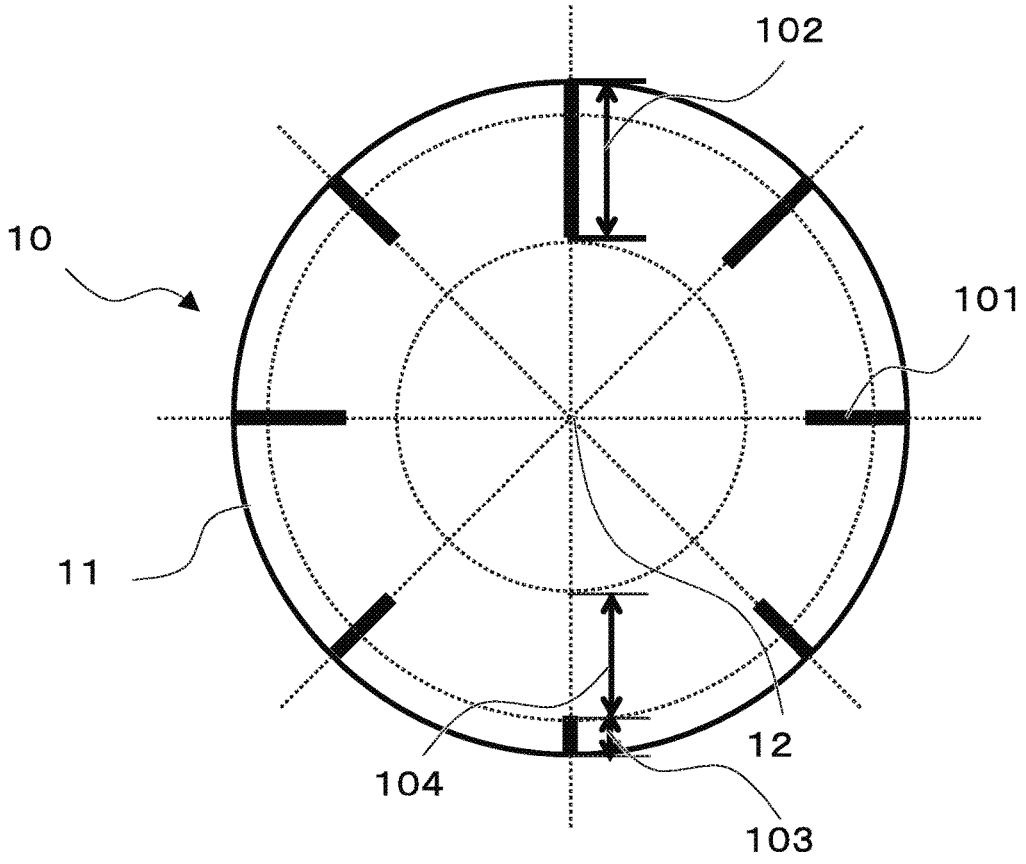
FIG. 1 Figure showing distribution of hardening depth in cross section of steel bar according to one embodiment of the present invention.

Hereinafter, details of an embodiment of the present invention (hereinafter, called the present embodiment) will be described.

First, the reason for limiting the chemical composition of the steel bar according to the present embodiment will be described. Hereinafter, the amounts of alloy compositions in mass % will simply be described as "%".

(C: 0.30 to 0.80%)

C is an element having a great effect on strength of the steel bar. If an amount of C is less than 0.30%, sufficient hardness cannot be obtained after induction hardening. On the other hand, if the amount of C is more than 0.80%, a large amount of residual austenite forms during the induction hardening and prevents the hardness increasing. Therefore, the amount of C of the steel bar according to the present embodiment is 0.30 to 0.80%. In order to advantageously obtain the above-described effects, the lower limit of the amount of C is preferably 0.40%, and more preferably 0.50%.

(Si: 0.01 to 1.50%)

Si is an element effective for deoxidizing the steel, as well as effective for strengthening ferrite and increasing resistance to temper softening. If an amount of Si is less than 0.01%, the effect is insufficient. If the amount of Si is more than 1.50%, material property is deteriorated due to embrittlement of the steel bar, and carburizability is deteriorated. Therefore, it is necessary that the amount of Si is within a range of 0.01 to 1.50%. In order to advantageously obtain the above-described effects, the lower limit of the amount of Si is preferably 0.03%, and more preferably 0.05%. The upper limit of the amount of Si is preferably 0.50%, and more preferably 0.40%.

(Mn: 0.05 to 2.50%)

Mn fixes S in the steel as MnS. MnS disperses in the steel. In addition, Mn is an element necessary for increasing hardenability of the steel and for securing strength of the steel after quenching by forming solid-solution of Mn with matrix. However, if the amount of Mn is less than 0.05%, S in the steel combines with Fe to form FeS which embrittles the steel. On the other hand, if the amount of Mn is more than 2.50%, the above-described effects of Mn on the strength and the hardenability is saturated. Therefore, the amount of Mn is 0.05 to 2.50%. In order to obtain the above-described effects more efficiently, the preferable lower limit of the amount of Mn is 0.20% and a more preferable lower limit of the amount of Mn is 0.30%. The preferable upper limit of the amount of Mn is 1.80% or less and a more preferable upper limit of the amount of Mn is 1.60%.

(Al: 0.010 to 0.30%)

Al has a deoxidizing effect. In addition, Al forms Al nitride (AlN), and suppresses coarsening of grain. Furthermore, Al fixes solid-solution N in the steel as AlN. If B is included in the steel, the solid-solution N combines with B in the steel to form BN, and decreases the amount of solid-solution B. If B is included in the steel, Al is effective for securing the amount of the solid-solution B which increases hardenability. In order to obtain the above-described effects, it is necessary that 0.010% or more of Al is included. On the other hand, if the amount of Al is excess, $Al_2O_3$ forms, and deteriorates fatigue strength as well as causes cold-forging crack. Therefore, it is necessary that the upper limit of the amount of Al is 0.30%. In order to obtain the above-described effects more efficiently, preferable lower limit of the amount of Al is 0.015%, and a more preferable lower limit of the amount of Al is 0.020%. The preferable upper limit of the amount of Al is 0.25% or less and a more preferable upper limit of the amount of Al is 0.15%.

(N: 0.0040 to 0.030%)

N combines with Al, Ti, Nb, and V in the steel to form fine nitrides or fine carbonitrides. The fine nitrides or the fine carbonitrides have an effect for suppressing coarsening of the grain. If the amount of N is less than 0.0040%, the effect is insufficient. If the amount of N is more than 0.030%, the effect is saturated. In addition, if the amount of N is more than 0.030%, carbonitrides which does not form solid-solution during heating at hot-rolling or during heating at hot-forging remain in the steel bar, and the amount of the fine carbonitrides which is effective for suppressing coarsening of the grain decreases. Therefore, it is necessary that the amount of N is within a range of 0.0040 to 0.030%. In order to obtain the above-described effects more efficiently, preferable lower limit of the amount of N is 0.0045% and a more preferable lower limit of the amount of N is 0.0050%. The preferable upper limit of the amount of N is 0.015% or less and a more preferable upper limit of the amount of N is 0.010%.

(P: 0.035% or Less)

P is an impurity element. If the amount of P is more than 0.035%, casting property and hot workability deteriorate. In addition, if the amount of P is more than 0.035%, the hardness of the steel bar before quenching increases, and the machinability of the steel bar deteriorates. Therefore, the amount of P is 0.035% or less. In order to further suppress deterioration of the machinability, the hot workability, and the casting property due to P, the preferable upper limit of the amount of P is 0.025% and a more preferable upper limit of the amount of P is 0.015%. It is preferable that the amount of P is as small as possible, and thus, it is not necessary to provide the lower limit of the amount of P. The lower limit of the amount of P may be 0%.

(S: 0.10% or Less)

S is an impurity element. In addition, S combines with Mn in the steel to form MnS. Although Mn is effective for increasing the machinability of the steel bar, if the amount of S is more than 0.10%, MnS coarsens. The coarse MnS acts as a crack origin during hot-rolling, and thus, the coarse MnS deteriorates hot workability. Therefore, it is necessary that the amount of S is 0.10% or less. In order to further suppress deterioration of the hot workability, the preferable upper limit of the amount of S is 0.05% and a more preferable upper limit of the amount of S is 0.02%. It is not necessary to provide the lower limit of the amount of S. The lower limit of the amount of S may be 0%. On the other hand, in order to stably obtain the effect for enhancing the machinability, the lower limit of the amount of S may be 0.02%.

In order to enhance the hardenability and the strength, the steel bar may include Cr: 0 to 3.0%, Mo: 0 to 1.5%, Cu: 0 to 2.0%, Ni: 0 to 5.0%, and B: 0 to 0.0035% as optional elements.

(Cr: 0 to 3.0%)

Cr is an optional element, and it is not necessary that the steel bar includes Cr as chemical composition. Therefore, the lower limit of the amount of Cr is 0%. On the other hand, Cr is an element which enhances the hardenability of the steel bar and provides resistance to temper softening to the steel bar, and thus, the steel which needs high strength may include Cr. If a large amount of Cr is included, Cr carbides form and embrittle the steel bar. Therefore, the amount of Cr of the steel bar according to the present embodiment is 0 to 3.0%. In a case in which Cr is included for obtaining the above-described effects, the preferable lower limit of the amount of Cr is 0.1% and a more preferable lower limit of the amount of Cr is 0.4%. The preferable upper limit of the amount of Cr is 2.5% and a more preferable upper limit of the amount of Cr is 2.0%.

(Mo: 0 to 1.5%)

Mo is an optional element, and it is not necessary that the steel bar includes Mo as chemical composition. Therefore, the lower limit of the amount of Mo is 0%. On the other hand, Mo provides the resistance to temper softening to the steel bar and enhances the hardenability of the steel bar, and thus, the steel which needs high strength may include Mo. If the amount of Mo is more than 1.5%, the effect of Mo is saturated. Therefore, in a case in which Mo is included, the upper limit of the amount of Mo is 1.5%. In a case in which Mo is included for obtaining the above-described effects, preferable lower limit of the amount of Mo is 0.10% and a more preferable lower limit of the amount of Mo is 0.15%.

The preferable upper limit of the amount of Mo is 1.1% and a more preferable upper limit of the amount of Mo is 0.70%.

(Cu: 0 to 2.0%)

Cu is an optional element, and it is not necessary that the steel bar includes Cu as chemical composition. Therefore, the lower limit of the amount of Cu is 0%. On the other hand, Cu is an element which is effective for strengthening ferrite, enhancing the hardenability, and enhancing corrosion resistance. If the amount of Cu is more than 2.0%, the effects regarding mechanical property are saturated. And thus, in a case in which Cu is included, the upper limit of the amount of Cu is 2.0%. Particularly, Cu may deteriorate hot ductility of the steel bar and may cause a flaw which forms during hot-rolling, and thus, it is preferable that Cu be included together with Ni. In order to obtain the above-described effects more efficiently, the preferable lower limit of the amount of Cu is 0.05% and a more preferable lower limit of the amount of Cu is 0.10%. The preferable upper limit of the amount of Cu is 0.40% and a more preferable upper limit of the amount of Cu is 0.30%.

(Ni: 0 to 5.0%)

Ni is an optional element, and it is not necessary that the steel bar includes Ni as chemical composition. Therefore, the lower limit of the amount of Ni is 0%. On the other hand, Ni is an element which is effective for enhancing ductility of the ferrite, enhancing the hardenability, and enhancing the corrosion resistance. If the amount of Ni is more than 5.0%, the effects regarding mechanical property are saturated and the machinability of the steel bar deteriorates. And thus, in a case in which Ni is included, the upper limit of the amount of Ni is 5.0%. In order to obtain the above-described effects more efficiently, the preferable lower limit of the amount of Ni is 0.1% and a more preferable lower limit of the amount of Ni is 0.40%. The preferable upper limit of the amount of Ni is 4.5% and a more preferable upper limit of the amount of Ni is 3.5%.

(B: 0 to 0.0035%)

B is an optional element, and it is not necessary that the steel bar includes B as chemical composition. Therefore, the lower limit of the amount of B is 0%. On the other hand, B segregates at grain boundary as solid-solution B to enhance the hardenability of the steel bar and the strength of the grain boundary, and thus, B enhances the fatigue strength and impact strength which are required to machine component. On the other hand, if the amount of B is more than 0.0035%, the above-described effects are saturated and the hot ductility of the steel bar deteriorates significantly. And thus, in a case in which B is included, the upper limit of the amount of B is 0.0035%. In order to obtain the above-described effects more efficiently, the preferable lower limit of the amount of B is 0.0010% and a more preferable lower limit of the amount of B is 0.0015%. The preferable upper limit of the amount of B is 0.0030%.

In addition, in order to control the configuration of oxides and sulfides, the steel bar according to the present embodiment may include one or more selected from the group consisting of Ca, Zr, Mg, and Rem as optional elements.

(Ca: 0 to 0.0050%)

Ca is an optional element, and it is not necessary that the steel bar includes Ca as chemical composition. Therefore, the lower limit of the amount of Ca is 0%. On the other hand, Ca is a deoxidizing element and forms oxides in the steel bar. In steel including Al, such as the steel bar according to the present embodiment, Ca forms calcium aluminate ($CaOAl_2O_3$). $CaOAl_2O_3$ is oxide of which the melting point is lower than that of $Al_2O_3$, and forms tool protection film during high speed cutting to enhance the machinability of the steel bar. On the other hand, if the amount of Ca is more than 0.0050%, CaS forms in the steel and deteriorates the machinability. Therefore, in a case in which Ca is included, the upper limit of the amount of Ca is 0.0050%. In order to obtain the above-described effects more efficiently, the preferable lower limit of the amount of Ca is 0.0001% and a more preferable lower limit of the amount of Ca is 0.0002%. The preferable upper limit of the amount of Ca is 0.0035% and a more preferable upper limit of the amount of Ca is 0.0030%.

(Zr: 0 to 0.0050%)

Zr is an optional element, and it is not necessary that the steel bar include Zr in the chemical composition. Therefore, the lower limit of the amount of Zr is 0%. On the other hand, Zr is a deoxidizing element and forms oxides in the steel bar. It is assumed that the oxides are $ZrO_2$. Since $ZrO_2$ acts as precipitation nuclei of MnS, $ZrO_2$ increases the number of locations at which MnS precipitates to uniformly disperse MnS in the steel bar, and thus, $ZrO_2$ has an effect for enhancing the machinability. In addition, since Zr incorporates into MnS in a solid-solution state to form complex sulfides and decreases deformability of MnS, Zr has an effect for suppressing elongation of MnS during hot-rolling and hot forging. On the other hand, if the amount of Zr is more than 0.0050%, yield of the steel bar significantly deteriorates, and a huge amount of hard compounds such as $ZrO_2$, ZrS, and the like form to deteriorate the mechanical properties of the steel bar such as the machinability, impact value, fatigue property, and the like. Therefore, in a case in which Zr is included, the upper limit of the amount of Zr is 0.0050%. In order to obtain the above-described effects more efficiently, the preferable lower limit of the amount of Zr is 0.0003%. The preferable upper limit of the amount of Zr is 0.0035%.

(Mg: 0 to 0.0050%)

Mg is an optional element, and it is not necessary that the steel bar includes Mg as chemical composition. Therefore, the lower limit of the amount of Mg is 0%. On the other hand, Mg is a deoxidizing element and forms oxides in the steel bar. In a case in which deoxidizing with Al is performed, Mg reform at least a part of $Al_2O_3$, which deteriorates the machinability, into MgO. Since MgO is relatively soft and finely disperses, MgO does not deteriorate the machinability of the steel bar. Therefore, Mg has an effect for suppressing deterioration of the machinability due to the deoxidization with Al. In addition, Mg oxides act as nuclei of MnS, and thus, have an effect for finely dispersing MnS. Furthermore, Mg forms complex sulfides with MnS, and thus, Mg has an effect for spheroidizing MnS. On the other hand, if the amount of Mg is more than 0.0050%, Mg forms MgS to deteriorate the machinability of the steel bar. Therefore, in a case in which Mg is included, the upper limit of the amount of Mg is 0.0050%. In order to obtain the above-described effects more efficiently, the preferable lower limit of the amount of Mg is 0.0003%. The preferable upper limit of the amount of Mg is 0.0040%.

(Rem: 0 to 0.0150%)

Rem (rare-earth element) is an optional element, and it is not necessary that the steel bar includes Rem as chemical composition. Therefore, the lower limit of the amount of Rem is 0%. On the other hand, Rem is a deoxidizing element, and has an effect for forming low-melting oxides to suppress nozzle clogging during casting. In addition, Rem incorporates into MnS in a solid-solution state or combines with MnS to decrease deformability of MnS, and thus, Rem suppresses the elongation of MnS during the hot-rolling and the hot forging. As described above, Rem is an element effective for reducing anisotropy of the steel bar. If the amount of Rem is more than 0.0150%, a huge amount of Rem sulfides form and deteriorate the machinability. Therefore, in a case in which Rem is included, the upper limit of the amount of Rem is 0.0150%. In order to obtain the above-described effects more efficiently, the preferable lower limit of the amount of Rem is 0.0001%. The preferable upper limit of the amount of Rem is 0.0100%.

In addition, in order to increase strength by forming carbonitrides and to size austenite grains by the carbonitrides, one or more selected from the group consisting of Ti, Nb, V, and W may be included as optional elements.

(Ti: 0 to 0.150%)

Ti is an optional element, and it is not necessary that the steel bar includes Ti as chemical composition. Therefore, the lower limit of the amount of Ti is 0%. On the other hand, Ti is an element contributing to suppressing growth of the austenite grains and increasing strength of the austenite grains by forming the carbonitrides. A steel bar which should have high strength and a steel bar in which strain thereof should be reduced may include Ti as a sizing element for preventing the austenite grain coarsening. In addition, Ti is a deoxidizing element and has an effect for enhancing the machinability of the steel bar by forming soft oxides. On the other hand, if the amount of Ti is excessive, Ti-type sulfides form and decrease the amount of MnS which increases the machinability, and thus, the machinability of the steel is deteriorated. Therefore, the upper limit of the amount of Ti of the steel bar according to the present embodiment is 0.150%. In order to obtain the above-described effects more efficiently, the preferable lower limit of the amount of Ti is 0.003%. The preferable upper limit of the amount of Ti is 0.100%.

(Nb: 0 to 0.150%)

Nb is an optional element, and it is not necessary that the steel bar include Nb as chemical composition. Therefore, the lower limit of the amount of Nb is 0%. On the other hand, Nb is an element which forms carbonitrides, and contributes to increasing the strength of the steel by secondary precipitation hardening and suppressing the growth of the austenite grains. A steel bar which should have high strength and a steel bar in which strain thereof should be reduced may include Nb as a sizing element for preventing the austenite grain coarsening. If the amount of Nb is more than 0.150%, coarse carbonitrides which do not form solid-solution and which cause hot crack, and thus, mechanical properties are deteriorated. Therefore, in a case in which Nb is included, the upper limit of the amount of Nb is 0.150%. In order to obtain the above-described effects more efficiently, the preferable lower limit of the amount of Nb is 0.004%. The preferable upper limit of the amount of Nb is 0.100%.

(V: 0 to 1.0%)

V is an optional element, and it is not necessary that the steel bar includes V as chemical composition. Therefore, the lower limit of the amount of V is 0%. On the other hand, V is an element which forms carbonitrides, and contributes to increasing the strength of the steel by secondary precipitation hardening, suppressing the growth of the austenite grains, and increasing the strength of the austenite grains. A steel bar which should have high strength and a steel bar in which strain thereof should be reduced may include V as a sizing element for preventing the austenite grain coarsening. If the amount of V is more than 1.0%, coarse carbonitrides which do not form solid-solution and which cause hot crack, and thus, mechanical properties are deteriorated. Therefore, in a case in which V is included, the upper limit of the amount of V is 1.0%. In order to obtain the above-described effects more efficiently, the preferable lower limit of the amount of V is 0.03%.

(W: 0 to 1.0%)

W is an optional element, and it is not necessary that the steel bar includes W as chemical composition. Therefore, the lower limit of the amount of W is 0%. On the other hand, W is an element which forms carbonitrides, and contributes to increasing the strength of the steel by secondary precipitation hardening. If the amount of W is more than 1.0%, coarse carbonitrides which do not form solid-solution and which cause hot crack, and thus, mechanical properties are deteriorated. Therefore, in a case in which W is included, the upper limit of the amount of W is 1.0%. In order to obtain the above-described effects more efficiently, the preferable lower limit of the amount of W is 0.01%.

In addition, in order to enhance the machinability, one or more selected from the group consisting of Sb, Sn, Zn, Te, Bi, and Pb may be included as optional elements.

(Sb: 0 to 0.0150%)

Sb is an optional element, and it is not necessary that the steel bar includes Sb as chemical composition. Therefore, the lower limit of the amount of Sb is 0%. On the other hand, Sn moderately embrittles ferrite and enhances the machinability of the steel bar. In a case in which the amount of solid-solution Al is large, the effect is significantly exhibited. On the other hand, if the amount of Sb is more than 0.0150%, the amount of macro segregation of Sb become excess, and thus, the impact value of the steel bar significantly deteriorates. And thus, in a case in which Sb is included, the upper limit of the amount of Sb is 0.0150%. In order to obtain the above-described effects more efficiently, the preferable lower limit of the amount of Sb is 0.0005%.

(Sn: 0 to 2.0%)

Sn is an optional element, and it is not necessary that the steel bar includes Sn as chemical composition. Therefore, the lower limit of the amount of Sn is 0%. On the other hand, Sn has an effect for embrittling the ferrite to extend the service life of the tool and an effect for improving surface roughness of the steel bar. However, if the amount of Sn is more than 2.0%, the effects are saturated. Therefore, in a case in which Sn is included, the upper limit of the amount of Sn is 2.0%. In order to obtain the above-described effects more efficiently, the preferable lower limit of the amount of Sn is 0.005%.

(Zn: 0 to 0.50%)

Zn is an optional element, and it is not necessary that the steel bar includes Zn as chemical composition. Therefore, the lower limit of the amount of Zn is 0%. On the other hand, Zn has an effect for embrittling the ferrite to extend the service life of the tool and an effect for improving the surface roughness of the steel bar. However, if the amount of Zn is more than 0.50%, the effects are saturated. Therefore, in a case in which Zn is included, the upper limit of the amount of Zn is 0.50%. In order to obtain the above-described effects more efficiently, the preferable lower limit of the amount of Zn is 0.0005%.

(Te: 0 to 0.20%)

Te is an optional element, and it is not necessary that the steel bar includes Te as chemical composition. Therefore, the lower limit of the amount of Te is 0%. On the other hand, Te is an element enhancing the machinability. In addition, Te forms MnTe which coexists with MnS and decreases deformability of MnS, and thus, Te has an effect for suppressing the elongation of MnS. Accordingly, Te is an element effective for reducing anisotropy of the steel bar. However, if the amount of Te is more than 0.20%, the effects are saturated, and Te may cause flaw due to a decrease in hot ductility. Therefore, in a case in which Te is included, the upper limit of the amount of Te is 0.20%. In order to obtain the above-described effects more efficiently, the preferable lower limit of the amount of Te is 0.0003%.

(Bi: 0 to 0.50%)

Bi is an optional element, and it is not necessary that the steel bar includes Bi as chemical composition. Therefore, the lower limit of the amount of Bi is 0%. On the other hand, Bi is an element enhancing the machinability. However, if the amount of Bi is more than 0.50%, the effect for enhancing the machinability is saturated, and Bi may cause flaws due to a decrease in hot ductility. Therefore, in a case in which Bi is included, the upper limit of the amount of Bi is 0.50%. In order to obtain the above-described effects more efficiently, the preferable lower limit of the amount of Bi is 0.005%.

(Pb: 0 to 0.50%)

Pb is an optional element, and it is not necessary that the steel bar includes Pb as chemical composition; Therefore, the lower limit of the amount of Pb is 0%. Pb is an element enhancing the machinability. However, if the amount of Pb is more than 0.50%, the effect for enhancing the machinability is saturated, and Pb may cause flaws due to a decrease in hot ductility. Therefore, in a case in which Pb is included, the upper limit of the amount of Pb is 0.50%. In order to obtain the above-described effects more efficiently, the preferable lower limit of the amount of Pb is 0.005%.

The chemical composition of the steel bar according to the present embodiment is described above. Remainder of the chemical composition of the steel bar according to the present embodiment is Fe and impurity. The impurity is a component which is incorporated from raw materials such as mineral or scrap or by various factors in a manufacturing process when the steel bar is industrially manufactured, and is accepted within a range that does not adversely affect the property of the steel bar according to the present embodiment. Although the preferable lower limits of the optional elements are described, the properties of the steel bar according to the present embodiment are not deteriorated even if the amounts of the optional elements are lower than the above-described the preferable lower limits. Therefore, the amounts of the optional elements included in the steel bar according to the present embodiment may be lower than the above-described the preferable lower limits.

Figure 5:
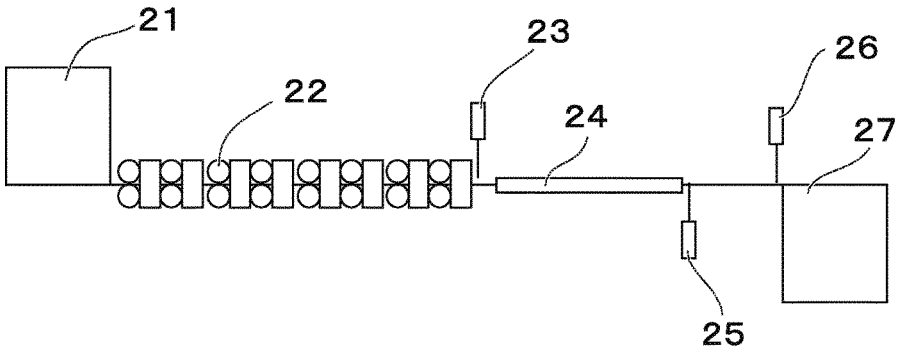
FIG. 5 Figure showing an example of outline of rolling line and water cooling apparatus constructing manufacturing apparatus for the steel bar according to the one embodiment of the present invention.
Figure 6:
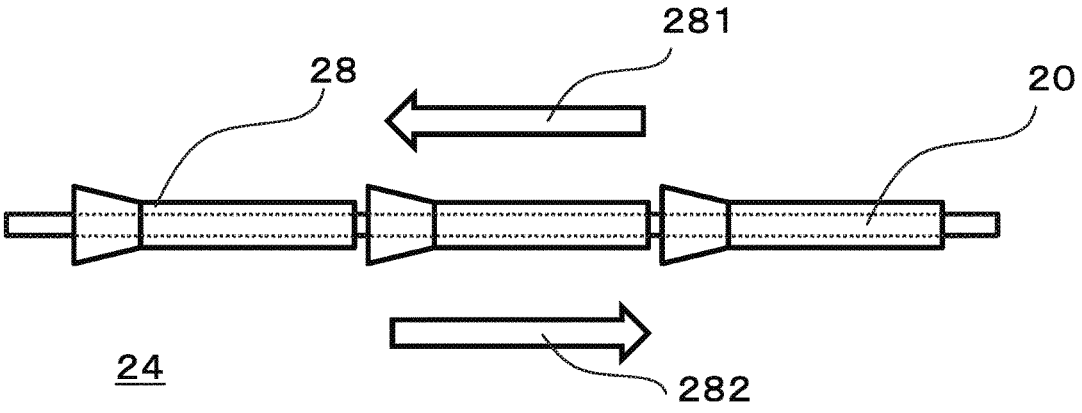
FIG. 6 Figure showing an example of outline of the water cooling apparatus constructing manufacturing apparatus for the steel bar according to the one embodiment of the present invention.
Figure 7:
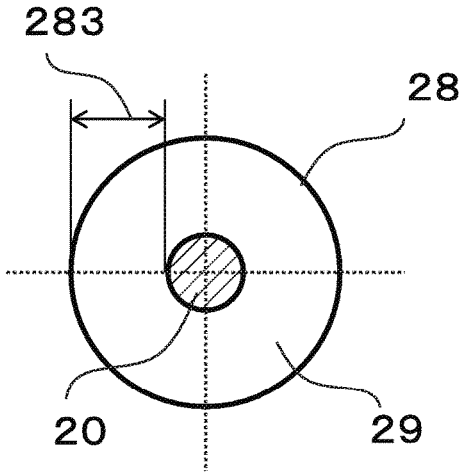
FIG. 7 Figure showing an example of outline of the water cooling apparatus constructing manufacturing apparatus for the steel bar according to the one embodiment of the present invention.
Figure 8:
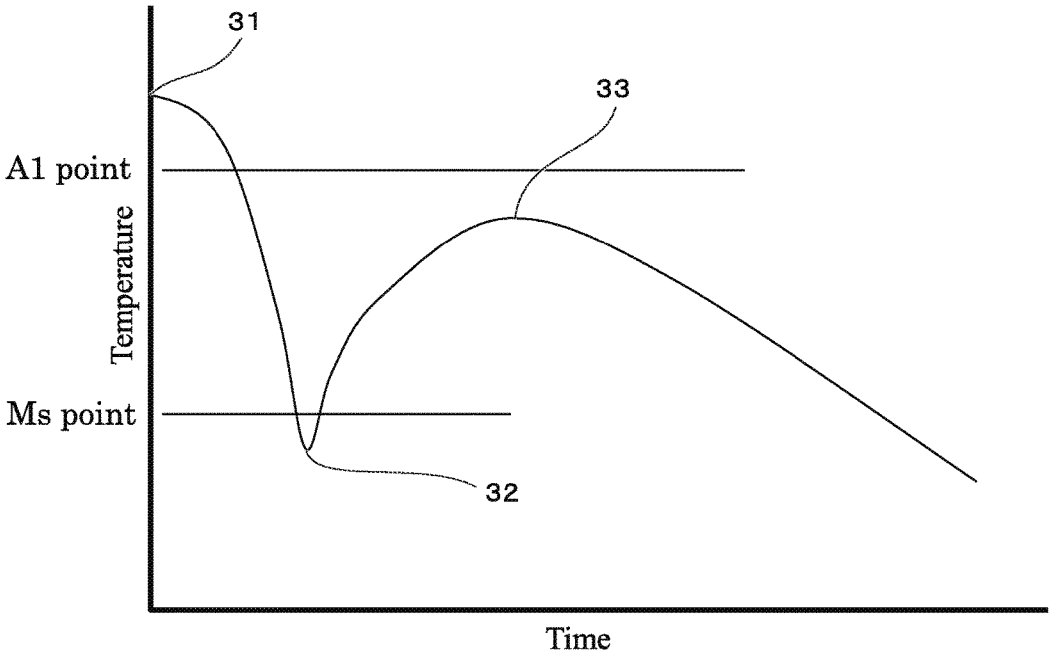
FIG. 8 Figure showing an example of outline of rapid-cooling just after rolling and reheating during method for manufacturing the steel bar according to the one embodiment of the present invention.

Next, a reason for limitations regarding a structure and a hardness of the steel bar according to the present embodiment will be described with reference to FIGS. 1 to 4 showing construction of the steel bar, FIGS. 5 to 7 showing construction of a manufacturing equipment of the steel bar, and FIG. 8 showing method for manufacturing the steel bar.

Intensive studies have been carried out by inventors on a method which can obtain the steel bar 1 having high crack propagation stopping properties, excellent base material low temperature toughness, and high induction hardenability, and which can manufacture the steel bar 1 with high efficiency and without thermal refining. As a result, the inventors found that it is effective for obtaining the steel bar 1 having high crack propagation stopping properties, excellent base material low temperature toughness, and high induction hardenability that a structure of a surface layer area 13 of the steel bar 1 is a tempered martensite, a bainite, or a mixed structure having the tempered martensite and the bainite, that the structure of the surface layer area 13 of the steel bar 1 is refined, and that formation of a ferrite is suppressed. In the present invention, the surface layer area 13 is an area from a surface 15 of the steel bar 1 to a depth of 25% of a radius r of the steel bar 1. In addition, in the present invention, the tempered martensite may be simply referred as "martensite". Moreover, the inventors found that it is effective for obtaining the steel bar 1 having above-described features that steel bar 1 is rapidly cooled just after hot-rolling, and then reheated.

Typical thermal refining includes quenching and tempering. In rapid-cooling during the quenching, the steel bar 1 is sufficiently cooled so that a center portion thereof is cooled, and then, the steel bar 1 is heated during the tempering. The thermal refining can bring the steel bar 1 having predetermined surface hardness, high crack propagation stopping properties, and low temperature toughness. In an entire cross section 10 of the steel bar 1 (a cross section perpendicular to a longitudinal direction of the steel bar 1), the structure is mainly the tempered martensite and the amount of the ferrite is small, and the structure is refined. On the other hand, during manufacturing the steel bar 1 according to the present embodiment, the steel bar 1 is rapidly cooled just after hot-rolling, and then the surface of the steel bar is heated by self-reheating due to sensible heat of inner portion of the steel bar. In this case, although a surface part of the steel bar 1 is heat-treated similar to the typical thermal refining, the center of the steel bar 1 is not cooled and heated. In the case in which the steel bar 1 is sufficiently cooled so that a center portion thereof is cooled, the reheating is not occur and the surface part of the steel bar 1 is not sufficiently heated. Therefore, surface hardness of the steel bar 1 after the reheating increases excessively and the machinability of the steel bar 1 deteriorates. The inventors found that in order to suppress the increase of the surface hardness of the steel bar 1 after the reheating, the structure of the surface layer area 13 of the cross section 10 can be controlled to be fine tempered martensite, fine bainite, or fine mix structure of the tempered martensite and the bainite by adequately controlling condition of the rapid-cooling to the steel bar 1 just after the hot-rolling so that only the surface of the steel bar 1 is rapidly cooled and reheated. Furthermore, the inventors found that it is effective for increasing productivity if unevenness of hardening depth after the reheating is suppressed.

That is, the steel bar 1 according to the present embodiment is the steel bar 1 which is rapidly cooled just after hot-rolling and then reheated, in which a region which is along a line (line segment) extending between a center 12 of a cross section 10 of the steel bar 1 and a periphery 11 of the cross section 10 of the steel bar 1 and which has a hardness higher than the average hardness in the line by Hv20 or more is a hardening in the line, a minimum value of depth of the hardening regions 101 in the 8 lines of which the angle is 45° is a minimum hardening depth 103 in the cross section 10, and the maximum value of the depth of the hardening regions 101 in the 8 lines is the maximum hardening depth 102 in the cross section 10, in which a difference between the maximum hardening depth 102 in the cross section 10 and the minimum hardening depth 103 in the cross section 10 is 1.5 mm or less, in which a difference between the maximum value of the maximum hardening depth 102 and a minimum value of the maximum hardening depth 102 in the cross sections 10 at 3 points $C_1$, $C_2$, and $C_3$ which are separated from each other by 1650 mm parallel to a longitudinal direction of the steel bar 1 is 1.5 mm or less, in which a difference between the maximum value of the minimum hardening depth 103 and a minimum value of the minimum hardening depth 103 in the cross sections 10 at the 3 points $C_1$, $C_2$, and $C_3$ which are separated from each other by 1650 mm parallel to the longitudinal direction of the steel bar 1 is 1.5 mm or less, in which a structure in an area from a surface 15 of the steel bar 1 to a depth of 25% of a radius r of the steel bar 1 includes 10 area % or less of a ferrite and a remainder including one or more selected from a group consisting of a bainite and a martensite, in which a boundary between grains which are adjacent to each other and of which an orientation difference is 15 degree or more is a grain boundary, and an equivalent circle diameter of an area surrounded by the grain boundary is a grain size, in which the average value of the grain size of a bcc phase in the area from the surface 15 of the steel bar 1 to the depth of 20% of the radius r of the steel bar 1 is 1.0 to 10.0 μm, in which the average value of the grain size of the bcc phase in an area from the depth of 50% of the radius r of the steel bar 1 to the center 12 of the steel bar 1 is 1.0 to 15.0 μm, in which a hardness of a region 105 of which a depth from the surface 15 is 50 μm is Hv200 to Hv500, and in which a total decarburized layer thickness DM-T is 0.20 mm or less.

(Difference between maximum hardening depth in cross section and minimum hardening depth in cross section: 1.5 mm or less)

(Difference between maximum value of maximum hardening depth and minimum value of maximum hardening depth in cross sections at 3 points which are separated from each other by 1650 mm parallel to longitudinal direction of steel bar: 1.5 mm or less)

(Difference between maximum value of minimum hardening depth and minimum value of minimum hardening depth in cross sections at 3 points which are separated from each other by 1650 mm parallel to longitudinal direction of steel bar: 1.5 mm or less)

In the steel bar 1 according to the present embodiment, a region which is along a line extending between a center 12 of a cross section 10 of the steel bar 1 and a periphery 11 of the cross section 10 of the steel bar 1 and which has a hardness higher than the average hardness in the line by Hv20 or more is a hardening region 101, the minimum value of depth of the hardening regions 101 in the 8 lines of which the angle is 45° is the minimum hardening depth 103 in the cross section 10, and the maximum value of the depth of the hardening regions 101 in the 8 lines is the maximum hardening depth 102 in the cross section 10.

Definitions of the terms will be described in detail with FIG. 1. The FIG. 1 shows an arbitrary cross section 10 (i.e. a section perpendicular to the longitudinal direction of the steel bar 1) of the steel bar 1. In a case in which hardness is continuously measured at any intervals, for example, at 200 μm intervals along an arbitrary line extending between a center 12 of the cross section 10 of the steel bar 1 and a periphery 11 of the cross section 10 of the steel bar 1, the average hardness along the arbitrary line can be obtained. In the steel bar 1 according to the present embodiment, only the surface part thereof is quenched and tempered, and thus, hardness of the surface part is higher than hardness of a center part. In the arbitrary line, a region having hardness higher than the average hardness in the arbitrary line by Hv20 or more is assumed as a region in which quench hardening occurs. Therefore, the above-described region of the steel bar 1 according to the present embodiment, in which the quench hardening occurs, is defined as a hardening region 101 in the line. Depth of the hardening region 101 regarding any line is assumed as hardening depth in the line. In addition, in the steel bar 1 according to the present embodiment, the minimum value of depth of the hardening regions 101 in the 8 lines of which the angle is 45° is defined as the minimum hardening depth 103 in the cross section 10, a maximum value of the depth of the hardening regions 101 in the 8 lines is defined as a maximum hardening depth 102 in the cross section 10, and a difference between the minimum hardening depth 103 in the cross section 10 and the maximum hardening depth 102 in the cross section 10 is defined as a quenching deflection 104 in the cross section. The quenching deflection 104 in the cross section is a value indicating unevenness in the cross section 10, and it is assumed that a cross section 10 of which the quenching deflection 104 in the cross section is small is quenched uniformly along circumferential direction of the cross section 10.

The steel bar 1 according to the present embodiment is manufactured by rapid-cooling a hot-rolled steel 20 after hot-rolling. During the rapid-cooling, along the entire of the hot-rolled steel 20 in circumferential direction and in longitudinal direction, the cooling is as uniform as possible. The reason is that uneven cooling makes the hardening depth uneven, which makes the structure and the hardness of the hot-rolled steel 20 and the steel bar 1 uneven in the circumferential direction and in the longitudinal direction. The unevenness of the structure and the unevenness of the hardness cause a warpage in the hot-rolled steel 20 after rapid-cooling to the hot-rolled steel 20, or cause the warpage in the steel bar 1 after induction hardening to the steel bar 1. If a marked warpage occurs, it is necessary to correct the warpage and yield decreases due to shape failure, and thus, the marked warpage decreases production efficiency of the steel bar 1. In order to keep the production efficiency of the steel bar 1 at a level preferable for industrial use, it is necessary that an amount of the warpage of the steel bar 1 is suppressed to less than 3 mm/m.

The inventors found that it is necessary for keeping the production efficiency of the steel bar 1 at a preferable level by suppressing the amount of the warpage of the steel bar 1 that the steel bar 1 is manufactured so that the quenching deflection 104 in the cross section in arbitrary cross sections 10 of the steel bar 1 is 1.5 mm or less. Thereby, the steel bar 1 having uniform hardening depth in the circumference direction can be obtained. In addition, the inventors found that it is necessary that the steel bar 1 is manufactured so that a difference between a maximum value of the maximum hardening depth 102 and the minimum value of the maximum hardening depth 102 in the cross sections 10 at 3 points $C_1$, $C_2$, and $C_3$ which are separated from each other by 1650 mm parallel to the longitudinal direction of the steel bar 1 (hereinafter, referred as "Δmax") is 1.5 mm or less and a difference between a maximum value of the minimum hardening depth 103 and the minimum value of the minimum hardening depth 103 in the cross sections 10 at the 3 points $C_1$, $C_2$, and $C_3$ which are separated from each other by 1650 mm parallel to the longitudinal direction of the steel bar 1 (hereinafter, referred as "Δmin") is 1.5 mm or less. Thereby, the steel bar 1 having uniform hardening depth in the longitudinal direction can be obtained. If one or more of the quenching deflection 104 in the cross section, the Δmax, and the Δmin is more than 1.5 mm, the amount of the warpage of the steel bar 1 increases to be more than 3 mm/m. The preferable upper limits of the quenching deflection 104 in the cross section, the Δmax, and the Δmin are 1.4 mm, 1.3 mm, or 1.2 mm. Since the smaller the quenching deflection 104 in the cross section, the Δmax, and the Δmin are, the more preferable it is, the lower limits of the quenching deflection 104 in the cross section, the Δmax, and the Δmin are 0 mm. However, it is difficult to completely relieve the unevenness of the hardening depth, and thus, substantial lower limits of the quenching deflection 104 in the cross section, the Δmax, and the Δmin may be about 0.7 mm.

Method for measuring the maximum hardening depth 102 in the arbitrary cross section 10 of the steel bar 1 and the minimum hardening depth 103 in the arbitrary cross section 10 of the steel bar 1 will be described below. At first, along a first line extending between a center 12 of a cross section 10 of the steel bar 1 and a periphery 11 of the cross section 10 of the steel bar 1, hardness is continuously measured at arbitrary intervals from the center 12 to the periphery 11. Next, the average hardness of the first line is calculated based on the obtained hardness values. Then, a region having hardness higher than the average hardness in the first line by Hv20 or more is assumed as a hardening region 101, and depth of the hardening region 101 (hardening depth) is measured. And then, along $n_{th}$ line ("n" is 2 to 8 of counting number) in which angle between the $n_{th}$ line and the 1st line is 45°×(n−1) and which extends between a center 12 of a cross section 10 of the steel bar 1 and a periphery 11 of the cross section 10 of the steel bar 1, hardness is continuously measured similar to the first line. The largest of the 8 kinds of hardening depth obtained thereby is the maximum hardening depth 102 in the arbitrary cross section 10 and the minimum of that is the minimum hardening depth 103 in the arbitrary cross section 10. Typically, the hardening region 101 obtained by the above-described measuring method is a continuous line of which the origin is the periphery 11 of the cross section 10. If the hardening region 101 is not the continuous line of which the origin is the periphery 11 of the cross section 10, the hardness values used for defining the hardening region 101 may not be correct. Conditions for measuring the hardness and the intervals during measuring the hardness are not limited. In view of the diameter and the hardness of the steel bar according to the present embodiment, for example, load during measuring the hardness may be 200 g and the intervals during measuring the hardness may be 100 μm.

(Average value of grain size of bcc phase in area from surface of steel bar to depth of 25% of radius of steel bar: 1.0 to 10.0 μm)

(Average value of grain size of bcc phase in area from depth of 50% of radius of steel bar to center of steel bar: 1.0 to 15.0 μm)

In view of safety, in a case in which the steel bar 1 is used for structure material of the machine component and the like (for example, a shaft, a pin, a cylinder rod, a steering rack bar, and a rebar, etc.), it is necessary that fracture morphology of the steel bar 1 is bending when the steel bar 1 is broken by some kind of impact or load beyond an expected level. Fracture morphology of typical structure material is rupture, i.e. a morphology by which the structure material is divided. On the other hand, it is important for safety of the structure material that the fracture morphology of the structure material is a fracture morphology such as bending by which only deformation occurs (i.e. breaking does not occur). The inventors made test pieces for supposing a circumstance in which the steel bar 1 is used for structure material by induction hardening the surface part of the steel bar 1, and then machining the steel bar 1 so as to be a shape having U notch of which depth is 1 mm. Next, the inventors performed three-point bend test on the test pieces in ethyl alcohol cooled to −40° C., and studied the effect of the grain size of bcc phase for the fracture morphology of each test pieces. As a result, during the three-point bend test on test pieces of which the bcc phase were sufficiently refined, i.e. test pieces in which average values of grain size of the bcc phase in areas (surface layer areas 13) from the surfaces 15 of steel bars 1 to depth of 25% of radius r of the steel bars 1 were 10.0 μm or less and in which average values of the grain size of the bcc phase in areas (center areas 14) from depth of 50% of radius r of the steel bars 1 to the centers 12 of the steel bars 1 were 15.0 μm or less, although cracks occurred from the bottoms of the U notches thereof, crack propagation was stopped. Therefore, the fracture morphology of the test pieces of which the bcc phase were sufficiently refined were determined as bending. In addition, charpy impact test pieces were corrected from the center portion of the steel bars 1 of which the bcc phase were sufficiently refined and charpy impact test at −40° C. was performed on the charpy impact test pieces, and it was found that charpy impact values of the center portions of the steel bars 1 of which the bcc phase were sufficiently refined were high. That is, the center portions of the steel bars 1 of which the bcc phase were sufficiently refined had excellent toughness. On the other hand, the three-point bend test and the charpy impact test were performed on test pieces of which the bcc phase were not sufficiently refined, i.e. test pieces in which average values of grain size of the bcc phase in surface layer areas 13 were more than 10.0 μm and/or in which average values of the grain size of the bcc phase in center areas 14 were more than 15.0 μm, and during the three-point bend test, the test pieces were not bended and divided into two pieces. That is, the fracture morphology of the test pieces of which the bcc phase were not sufficiently refined were determined as rupture. In addition, based on the charpy impact test, it was found that charpy impact values of the center portions of the steel bars 1 of which the bcc phase were not sufficiently refined were low. In the present invention, a boundary between grains which are adjacent to each other and of which an orientation difference is 15 degree or more is defined as a grain boundary, and an equivalent circle diameter of an area surrounded by the grain boundary is defined as a grain size.

In view of the above-described founding, in the steel bar 1 according to the present embodiment, the average value of the grain size of the bcc phase in the surface layer area 13 is defined as 1.0 to 10.0 μm and the average value of the grain size of the bcc phase in the center area 14 is defined as 1.0 to 15.0 μm. Since it is difficult in an industrially practicable way to decrease the average value of the grain size of the bcc phase to be 1.0 μm or lower, both of the lower limit of the average grain size of the bcc phase in the surface layer area 13 and that of the center area 14 is 1.0 μm. An intermediate area from depth of 25% of radius r of the cross section to depth of 50% of radius r of the cross section is a transitional area from the structure in the surface layer area 13 to the structure of the center area 14. In order to obtain the demanded average value of the grain size of the bcc phase, it is effective that finish rolling temperature 31 of hot-rolling is adequately controlled and rapid-cooling is performed just after the hot-rolling with a sufficient amount of water.

Method for measuring the average value of the grain size of the bcc phase in the surface layer area 13 of the steel bar 1 and that of the center area 14 of the steel bar 1 is not limited. For example, the values may be obtained by measuring the average value of the grain size of the bcc phase at positions shown in FIG. 4 with an Electron-Back-Scattering-Diffraction (EBSD) apparatus attached in a scanning electron microscope. An example of method for measuring the average value of the grain size of the bcc phase in the surface layer area 13 of the steel bar 1 is as follows. At first, crystal orientation maps of the bcc phase regarding areas of 400 μm×400 μm in each of eight measuring positions (black circle marks shown in FIG. 4) consisting of four measuring positions in portion 16 of which the depth is 200 μm from the surface 15 of the steel bar 1 and four measuring positions in portion 17 of which the depth is 25% of the radius r from the surface 15 of the steel bar 1. Then, boundary in the crystal orientation maps of the bcc phase, at which an orientation difference is 15 degree or more, is assumed as grain boundary of the bcc phase, and the average values of the grain size of the bcc phase in each of the eight measuring positions are measured using method of Johnson-Saltykov (see "QUANTITATIVE MICROSCOPY", Uchida Rokakuho, published at Jul. 30, 1972, R. T. DeHoff and F. N. Rhines, p 189). Then, the average value of the grain size of the bcc phase in the surface layer area 13 of the steel bar 1 can be obtained by further averaging the average values of the grain size of the bcc phase in each of the eight measuring positions. An example of method for measuring the average value of the grain size of the bcc phase in the center area 14 of the steel bar 1 is as follows. At first, average values of the grain size of the bcc phase in each of 9 measuring positions (white circle marks shown in FIG. 4) consisting of four measuring positions in portion 18 of which the depth is 50% of the radius r from the surface 15 of the steel bar 1, four measuring positions in portion 19 of which the depth is 75% of the radius r from the surface 15 of the steel bar 1, and one measuring position in center 12 of the cross section 10 of the steel bar 1 are measured using above-described method. Then, the average value of the grain size of the bcc phase in the center area 14 of the steel bar 1 can be obtained by further averaging the average values of the grain size of the bcc phase in each of the 9 measuring positions. The four measuring positions are selected so that the angles between adjacent lines which are between the four measuring positions and the center 12 of the cross section 10 of the steel bar 1 are about 90 degree. The four measuring positions in the portion 17 of which the depth is 25% of the radius r from the surface 10 of the steel bar 1, the four measuring positions in the portion 18 of which the depth is 50% of the radius r from the surface 10 of the steel bar 1, and the four measuring positions in the portion 19 of which the depth is 75% of the radius r from the surface 10 of the steel bar 1 are selected similarly.

(Structure in area from surface of steel bar to depth of 25% of radius of steel bar: 10 area % or less of ferrite and remainder including one or more selected from a group consisting of bainite and martensite)

(Total decarburized layer thickness DM-T: 0.20 mm or less)

In a case in which the steel bar 1 is used for structure material of the machine component and the like (for example, a shaft, a pin, a cylinder rod, and a steering rack bar, etc.), in order to provide a surface portion thereof with required strength and wear resistance, induction hardening is performed thereon. Therefore, induction hardenability is required for the steel bar 1 used as the structure material. If carbon content in the steel bar 1 decreases, the induction hardenability deteriorates, and thus, the predetermined hardness cannot be obtained. And thus, it is necessary that decarburization of the surface of the steel bar 1 is suppressed. In addition, if the amount of ferrite in the surface layer area 13 of the steel bar 1 increases, since the induction hardening is a short period (few seconds) of heating, the carbon does not sufficiently diffuse in the ferrite even if the induction hardening is performed. In this case, the carbon content in a portion which was the ferrite decreases and the hardness thereof after the induction hardening decreases, and thus, induction hardenability deteriorates.

The inventors found that it is necessary that a total decarburized layer thickness DM-T defined in JIS G 0558 "STEELS-DETERMINATION OF DEPTH OF DECARBURIZATION" is 0.20 mm or less for the good induction hardenability. If the total decarburized layer thickness DM-T is more than 0.20 mm, deficiencies such as lack of surface hardness after the induction hardening, and the like occurs.

In addition, the inventors determined that a structure in the surface layer area 13 of the steel bar 1 includes 10 area % or less of a ferrite and a remainder including one or more selected from the group consisting of a bainite and a martensite. If the structure is out of the determined range, deficiencies such as lack of surface hardness after the induction hardening, unevenness of the hardness, and the like occurs. In order to suppress the total decarburization, it is effective that billet heating temperature and billet heating time at hot-rolling is adequately controlled and rapid-cooling is performed on the hot-rolled steel 20 just after the hot-rolling. In order to suppress precipitation of the ferrite, it is effective that the hot-rolled steel 20 is quenched by the rapid-cooling on the hot-rolled steel 20 just after the hot-rolling so that the structure of the steel bar 1 includes one or more of the martensite and the bainite. In addition to the martensite and/or the bainite, the remainder of the structure of the surface layer area 13 of the steel bar 1 may include 5 area % or less of a pearlite and other structure of which the amount is small enough so that the properties of the steel bar according to the present embodiment is not affected thereby. However, the pearlite and the other structure are not essential. The structure of a portion other than the surface layer area 13 of the steel bar 1 according to the present embodiment may have various configuration and does not seriously affect the properties of the steel bar 1, and thus, the structure thereof does not limited. For example, the structure of the portion other than the surface layer area 13 of the steel bar 1 according to the present embodiment may be mainly ferrite-pearlite structure and may include other structures such as the bainite, the martensite, and the like.

(Hardness of region of which depth from surface is 50 μm: Hv200 to Hv500)

In a case in which the steel bar 1 is used for structure material of the machine component and the like (for example, a shaft, a pin, a cylinder rod, and a steering rack bar, etc.), typically, the steel bar is worked to be a desired shape by machine work such as cutting. In a case in which the hot-rolled steel 20 after the hot-rolling is rapid-cooled in order to refine the structure, the hardness of the steel bar 1 increases. However, if the hardness of the steel bar 1 is excess, the machinability of the steel bar 1 deteriorates, and thus, yield rate deteriorates and cost for cutting increases. Therefore, it is necessary to control the hardness of the steel bar 1. The inventors studied the machinability with plunge cutting, and found that the machinability of a steel bar 1 of which surface hardness (region 105 of which a depth from the surface is 50 μm) after reheating was more than Hv500 was significantly poor. Therefore, the surface hardness of the steel bar 1 according to the present embodiment is determined to be Hv500 or less (preferably Hv450 or less, and more preferably Hv400 or less). On the other hand, if the surface hardness of the steel bar 1 is lower than Hv200, strength required for parts cannot be obtained, and thus, the lower limit of the surface hardness after reheating is Hv200. The hardness at the region 105 of which the depth from the surface 15 of the steel bar 1 is 50 μm can be obtained by measuring hardness of the region 105 in the cross section 10 of the steel bar 1, the region being 50 μm inside from the periphery 11 of the cross section 10.

The diameter of the steel bar 1 according to the present embodiment is not limited. However, in view of capacity of the manufacturing equipment, the diameter of the steel bar 1 is substantially 19 to 120 mm.

Next, a method for manufacturing the steel bar 1 according to the present embodiment will be described. For example, the steel bar 1 according to the present embodiment is manufactured by a method having heating a steel (billet) having a chemical composition of the steel bar 1 according to the present embodiment to 1000 to 1200° C., keeping the steel therein during 100 to 130 second, hot-rolling the steel with a (finish rolling temperature 31 being 850 to 950° C. to obtain a hot-rolled steel 20, cooling the hot-rolled steel 20 just after finishing of the hot-rolling under a condition in which a water film thickness 283/diameter of the hot-rolled steel 20 is 0.1 to 0.5, and in which length of a water cooling zone (an area in a water cooling apparatus 24 from a water cooling starting point to a water cooling stopping point), passing speed of the hot-rolled steel 20 through the water cooling zone, and flow velocity of a cooling water 29 in the water cooling zone is adequately set, reheating a surface of the hot-rolled steel 20 to 500 to 600° C., and cooling the hot-rolled steel 20 to room temperature. It is necessary that the length of the water cooling zone, the passing speed of the hot-rolled steel 20 through the water cooling zone, and the flow velocity of the cooling water 29 in the water cooling zone are set so that surface temperature of the hot-rolled steel 20 after the cooling rises to 500 to 600° C.

In order to manufacture the structure as described above, a rolling line and a cooling apparatus illustrated in FIGS. 5 to 7 can be used. The hot-rolled steel 20 can be obtained by hot-rolling the steel, which is heated in the heating furnace 21, with the hot-rolling mill 22. The hot-rolled steel 20 which is hot-rolled is rapid-cooled just after the hot-rolling in the water cooling apparatus 24. The water cooling apparatus 24 is configured by a plurality of water cooling pipes 28 filled with cooling water 29, through which the cooling water 29 flows. When the hot-rolled steel 20 passes through the water cooling pipes 28, the cooling water 29 has a predetermined water film thickness 283. The water film thickness 283 is the average distance between the inner surface of the cooling pipes 28 and the outer surface of the hot-rolled steel 20. That is, the water film thickness 283 is a value of a radius of the inner surface of the cooling pipes 28 minus a radius of the hot-rolled steel 20. A diameter of the hot-rolled steel 20 is substantially equal to the diameter of the steel bar 1. The hot-rolled steel 20 passes through a plurality of the water cooling pipes 28 under adequate conditions so that only surface part of the hot-rolled steel 20 can be quenched. The surface part of the hot-rolled steel 20 leave from the water cooling apparatus 24 is reheated and self-tempered by sensible heat of inner portion of the hot-rolled steel 20. Temperature of the hot-rolled steel 20 just after the hot-rolling (which is substantially equal to the finish rolling temperature 31) can be measured by an infrared thermometer 23 for measuring the finish rolling temperature installed at an exit of the hot-rolling mill 22, and the water cooling temperature 32 can be measured by an infrared thermometer 25 for measuring the water cooling temperature installed at an exit of the water cooling apparatus 24. The reheating temperature 33 can be measured by an infrared thermometer 26 for measuring reheating temperature installed at a place in which the reheating is performed. As shown in FIG. 8, the reheating temperature 33 is the maximum temperature of the surface of the hot-rolled steel 20 after finish of the water cooling.

If the heating temperature before the hot-rolling is less than 1000° C., deformation resistance during rolling increase, and thus, rolling force increases. In this case, deficiencies such as impossibility of the rolling, formation of a lot of rolling flaws even if the rolling can be performed, and the like may occur. In addition, if the heating temperature before the hot-rolling is more than 1200° C., deficiencies such as increasing the decarburized layer thickness of the steel bar 1, in which the hardness after the induction hardening lacks, and the like may occur:

If the keeping time of the heating before the hot-rolling is less than 100 second, unevenness of the temperature distribution in the billet increases, and thus, cracks occur during the hot-rolling. On the other hand, if the keeping time of the heating before the hot-rolling is more than 130 second, excess decarburization occurs.

If the finish temperature of the hot-rolling is less than 850° C., deficiencies such as occurring the rolling flaw, and increasing deformation resistance occur. On the other hand, if the finish temperature of the hot-rolling is more than 950° C., deficiencies such as coarsening the grain size of the bcc phase after rolling may occur, in which the structure after the induction hardening coarsens and crack propagation stopping properties of the steel bar 1 deteriorates.

The hardening depth and the reheating temperature 33 required for the steel bar 1 according to the present embodiment can be achieved by adequately controlling a number of the water cooling pipe 28 (i.e. total length of the water cooling pipe 28), transit speed of the hot-rolled steel 20, and flow velocity of the cooling water 29 in the water cooling pipe 28. Passing direction 281 of cooling water is opposite to passing direction 282 of the hot-rolled steel 20. The larger the number of the water cooling pipes 28, the slower the transit speed of the hot-rolled steel 20, and/or the faster the flow velocity of the cooling water 29, the deeper the hardening depth and the lower the reheating temperature. On the other hand, the smaller the number of the water cooling pipes 28, the faster the transit speed of the hot-rolled steel 20, and/or the slower the flow velocity of the cooling water 29, the shallower the hardening depth and the higher the reheating temperature. However, controlling cooling condition with changing the total length of the water cooling pipes 28 causes enlargement and complication of the cooling apparatus. In addition, controlling cooling condition with controlling the transit speed of the hot-rolled steel 20 makes the productivity of the steel bar 1 unstable. Therefore, in view of the industrial applicability, a method in which the number of the water cooling pipe 28 (i.e. the total length of the water cooling pipe 28) and the transit speed of the hot-rolled steel 20 are constant and the flow velocity of the cooling water 29 is controlled is an easiest way for controlling the cooling condition.

It is necessary that the cooling condition is controlled so that the reheating temperature (a maximum value of the surface temperature of the hot-rolled steel 20 risen by the reheating) after the cooling is 500 to 600° C. For example, in a case in which the total length of the water cooling pipe 28 is 20 m and the transit speed of the hot-rolled steel 20 is 4 m/s, the lower limit of the flow velocity of the cooling water 29 may be 0.4 m/s, preferably 0.6 m/s, and more preferably 0.8 m/s. In a case in which the total length of the water cooling pipe 28 is 20 m and the transit speed of the hot-rolled steel 20 is 4 m/s, the upper limit of the flow velocity of the cooling water 29 is 2 m/s. In a case such as the flow velocity of the cooling water 29 is excessive, the reheating temperature after the cooling is lower than 500° C.

In a process in which the hot-rolled steel 20 is in-line rapid-cooled just after the hot-rolling, it is important to evenly cool the hot-rolled steel 20. Uneven cooling causes unevenness of the hardening depth, and thus, the uneven cooling causes unevenness of the structure of the hot-rolled steel 20 and the steel bar 1 in circumferential direction and longitudinal direction. As described above, uneven structure (uneven hardening depth) causes warpage of the hot-rolled steel 20 after the rapid-cooling and warpage of the steel bar 1 after the induction hardening. If a marked warpage occurs, it is necessary to correct the warpage and yield decreases due to shape failure, and thus, the marked warpage decreases production efficiency of the steel bar 1. In order to suppress the decrease in the production efficiency of the steel bar 1, the unevenness of the hardening depth after the rapid-cooling just after the rolling and the reheating may be suppressed.

In order to suppress the quenching deflection 104 in cross section, the Δmax, and the Δmin to be 1.5 mm or less, a ratio R of the thickness of the water film covering the hot-rolled steel 20 and the diameter of the hot-rolled steel 20 (i.e. R="water film thickness 283"/"diameter of hot-rolled steel 20") and the flow velocity of the cooling water 29 are adequately controlled while the hot-rolled steel is cooled by passing the hot-rolled steel 20 through the water cooling pipes 28. It is effective that R is controlled to be a predetermined value or more and the flow velocity is controlled within an adequate range for uniformly cooling the hot-rolled steel 20. The inventors found that in a case in which R was 0.1 or more, the quenching deflection 104 in the cross section, the Δmax, and the Δmin of the steel bar were 1.5 mm or less. Therefore, the lower limit of R is 0.1, preferably 0.15 and more preferably 0.2. On the other hand, if R is excess, resistance during conveyance of the hot-rolled steel 20 increases, and thus, failure of the conveyance of the hot-rolled steel 20 occurs and productivity deteriorates. And thus, the upper limit of R is 0.5.

It is necessary that the other cooling conditions are controlled so that the reheating temperature 33 (the maximum value of the surface temperature of the hot-rolled steel 20 risen by the reheating) after the cooling is 500 to 600° C. For example, in a case in which the total length of the water cooling pipe 28 is 20 m and the transit speed of the hot-rolled steel 20 is 4 m/s, the lower limit of the flow velocity of the cooling water 29 may be 0.4 m/s, preferably 0.6 m/s, and more preferably 0.8 m/s. If the flow velocity of the cooling water 29 is excess, the reheating temperature 33 cannot be secured and the surface hardness after the reheating increases, and thus, in a case in which the total length of the water cooling pipe 28 is 20 m and the transit speed of the hot-rolled steel 20 is 4 m/s, the upper limit of the flow velocity of the cooling water 29 is 2 m/s.

If the reheating temperature is less than 500° C., the tempering is not sufficiently performed, and thus, the surface hardness of the steel bar increases and the machinability of the steel bar deteriorates. If the reheating temperature is more than 600° C., the hardening depth is insufficient.

EXAMPLES

Hereinafter, the present invention will be described with examples. The examples are merely for describing the present invention, and do not limit the scope of the invention.

Figure 2:
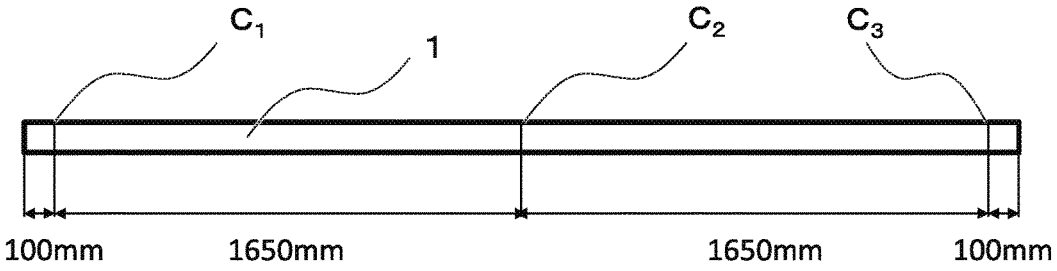
FIG. 2 Figure showing positions in longitudinal direction, at which the cross sections of the steel bar according to the one embodiment of the present invention are observed.
Figure 3:
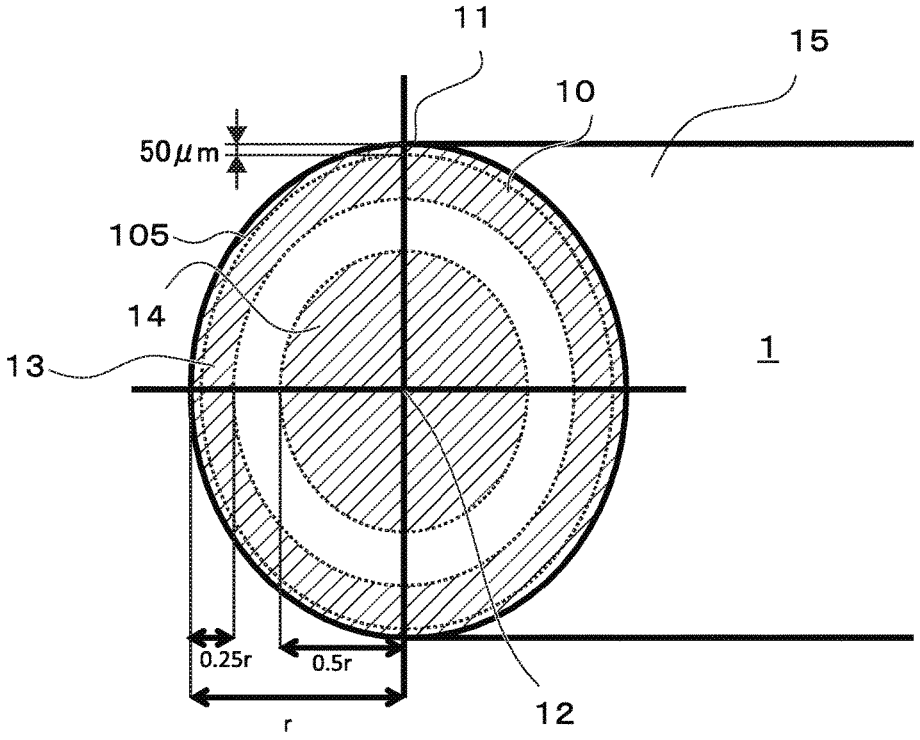
FIG. 3 Figure showing construction of the steel bar according to the one embodiment of the present invention.
Figure 4:
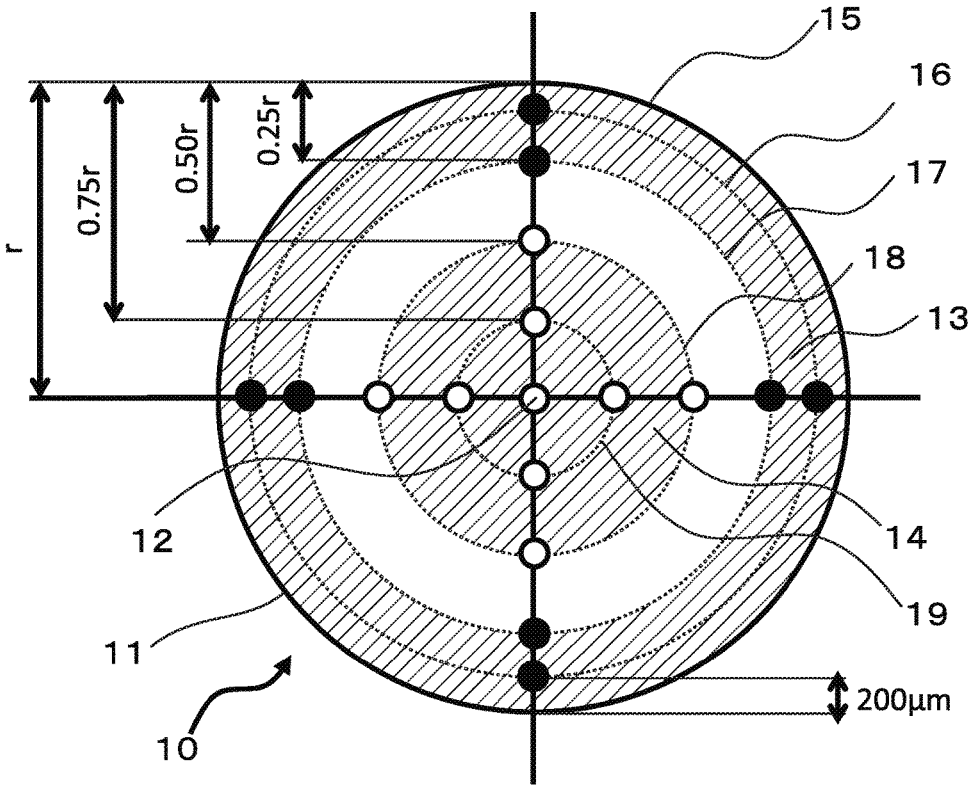
FIG. 4 Figure showing positions at which a grain size of a bcc phase in the cross section of the steel bar according to the one embodiment of the present invention is measured.

Hot-rolled steels having φ35 mm were obtained by hot-rolling billets having chemical composition shown in FIG. 1, having a height of 162 mm and a width of 162 mm and having a weight of 2 tons under conditions shown in FIG. 2 with a hot-rolling mill. Just after the hot-rolling, the hot-rolled steels having φ35 mm were rapid-cooled with a water cooling apparatus, and then reheated. Steel bars were obtained by air-cooling the hot-rolled steels after the reheating to room temperature. The finish temperature of the hot-rolling, the cooling temperature, and the reheating temperature were measured with infrared thermometers. Positional relation between each of the infrared thermometers, the hot-rolling mill, the water cooling apparatus, and a cooling bed is shown in FIGS. 5 to 7, and progression of the temperature of the steel bars is shown in FIG. 8.

Hereinafter, the above-described method for manufacturing will be described with reference to the FIGS. 5 to 7 showing an example of summary of the hot-rolling line according to the present invention. The hot-rolled steels 20 were obtained by hot-rolling the billets (steels), which were heated in a heating furnace 21, with the hot-rolling mill 22. The finish rolling temperature 31 was measured with an infrared thermometer 23 for measuring the finish rolling temperature. Just after the hot-rolling, the hot-rolled steels 20 were rapid-cooled with the water cooling apparatus 24. Then, the hot-rolled steels 20 were reheated, the reheating temperature 33 thereof was measured with an infrared thermometer 26 for measuring reheating temperature, and the hot-rolled steels 20 were air-cooled with the cooling bed 27. In Tables 2-1 to 2-3, the "HEATING TEMP." was the heating temperature of the hot-rolled steels 20 before the hot-rolling, the "HEATING TIME" was the time during keeping the hot-rolled steels 20 before the hot-rolling within the above-described heating temperature, the "FINISH ROLLING TEMP." was the finish temperature of the hot-rolling, "WATER FILM THICKNESS/DIA. OF STEEL" was the ratio R of the thickness of the water film and the diameter of the hot-rolled steel 20 (i.e. R="water film thickness 283"/"diameter of hot-rolled steel 20"), the "LENGTH OF WATER COOLING ZONE" was the total length of water cooling pipes 28, "SPEED PASSING WATER COOLING ZONE" was the speed of the hot-rolled steels 20 passing through the water cooling zone, and "FLOW VELOCITY" was the flow velocity of cooling water 29.

Hereinafter, the surface temperature history of surfaces of the steel bars during the above-described method for manufacturing will be described with reference the FIG. 8 showing example of summary of the rapid-cooling just after the hot-rolling according to the present invention. Cooling water 29 was poured on the surfaces of the hot-rolled steels 20 just after the finish rolling at the finish rolling temperature 31. By the pouring, temperature of the surface parts of the hot-rolled steels 20 were cooled to water cooling temperature 32. Then, the surfaces of the hot-rolled steels 20 were reheated to the reheating temperature 33 by sensible heat of inner portions of the hot-rolled steels 20. And then, the hot-rolled steels 20 were air-cooled in the cooling bed 27.

(Amount of Warpage)

The steel bars 1 were obtained by cooling the hot-rolled steels 20 to room temperature, and then, the steel bars 1 were cut to a length of 5 m. Then, a string was extended between the both sides of the steel bars 1 having a length of 5 m, and a distance between the string and the surfaces 15 of the steel bars 1 was measured at the center in the longitudinal direction of the steel bars 1 having a length of 5 m. The measured values of the distance divided by the length of the steel bars 1 (i.e. 5 m) were assumed as the amount of warpage of the steel bars 1.

(Decarburized Layer Thickness)

Decarburized layer thickness was obtained by measuring a total decarburized layer thickness DM-T with a method defined in JIS G 0558 "STEELS DETERMINATION OF DEPTH OF DECARBURIZATION".

(Hardness of Cross Section and Hardening Depth)

As shown in FIG. 2 showing positions $C_1$, $C_2$, and $C_3$ (cross section observation positions) in longitudinal direction in which the cross sections 10 of the steel bar 1 are observed, the steel bars 1 were vertically cut in the longitudinal direction at the three cross section observation positions consisting of $C_1$ and $C_3$, which were positions separated from the ends of the steel bars 1 having a length of 3500 mm, and $C_2$, which were in the center in the longitudinal direction of the steel bars 1. $C_1$, $C_2$, and $C_3$ were arranged at 1650 mm interval. The cut planes (cross sections 10) were polished and the hardness thereof was measured based on a procedure described hereinafter. At first, along a first line extending between a center 12 of a cross section 10 of the steel bar 1 and a periphery 11 of the cross section 10 of the steel bar 1, hardness was continuously measured at arbitrary intervals from the center 12 to the periphery 11. Next, the average hardness of the first line was calculated based on the obtained hardness values. Then, a region having a hardness higher than the average hardness in the first line by Hv20 or more was assumed as a hardening region 101, and the depth of the hardening region 101 (hardening depth) was measured. And then, along the $n_{th}$ line ("n" is 2 to 8 of counting number) in which angle between the $n_{th}$ line and the 1st line was 45°×(n−1) and which extended between a center 12 of a cross section 10 of the steel bar 1 and a periphery 11 of the cross section 10 of the steel bar 1, the hardness was continuously measured similarly to the first line. The largest of the 8 kinds of hardening depth obtained thereby was the maximum hardening depth 102 in the arbitrary cross section 10, the minimum of that was the minimum hardening depth 103 in the arbitrary cross section 10 of the steel bar 1, and difference of the maximum hardening depth 102 and the minimum hardening depth 103 was quenching deflection 104 in the cross section.

Maximum value of the quenching deflection 104 in the cross section was a maximum value of the quenching deflection 104 in the cross sections at $C_1$, $C_2$, and $C_3$. The maximum value of the quenching deflection 104 in the cross section indicated unevenness of hardening depth in the cross section.

Δmin was a difference between a maximum value of the minimum hardening depth 103 and the minimum value of the minimum hardening depth 103 in the cross sections at $C_1$, $C_2$, and $C_3$. Δmin indicated unevenness of the hardening depth in the longitudinal direction.

Δmax was a difference between a maximum value of the maximum hardening depth 102 and the minimum value of the maximum hardening depth 102 in the cross sections at $C_1$, $C_2$, and $C_3$. Δmax indicated unevenness of the hardening depth in the longitudinal direction.

(Amount of Ferrite in Surface Layer Area of Steel Bar)

The cross sections of the steel bars were polished, and etched with nital, and photographs of structure therein at positions of 25% depth of radius of the steel bars from the surfaces of the steel bars were taken with an optical microscope and with a magnification ratio of 500. Then, the photographs were printed out, regions which were not ferrite were painted in black, and regions which were ferrite and white in color were not painted. Thereafter, the papers were binarized with an image analyzing device, and ratios of area of the white regions in area of the papers (i.e. measured views) were calculated. The ratios of the area of the white regions in the area of the measured views were assumed to be the amount of the ferrite.

(Average Value of Grain Size of Bcc Phase)

The average values of the grain size of the bcc phase were measured with an Electron Back Scattering Diffraction (EBSD) apparatus attached to a scanning electron microscope in C-cross sections of the steel bars (i.e. cross sections perpendicular to rolling direction of the steel bars, or cross sections of the steel bars). Hereinafter, method for measuring will be described with reference to FIG. 4.

The average values of the grain size of the bcc phase in the surface layer areas 13 of the steel bars 1 were obtained as follows. At first, crystal orientation maps of the bcc phase regarding areas of 400 μm×400 μm in each of eight measuring positions consisting of four measuring positions in portions 16 of which the depth were 200 μm from the surfaces 15 of the steel bars 1 and four measuring positions in portions 17 of which the depth were 25% of the radius r from the surfaces 15 of the steel bars 1. Then, boundary in the crystal orientation maps of the bcc phase, at which an orientation difference was 15 degree or more, was assumed to be the grain boundary of the bcc phase, and the average values of the grain size of the bcc phase in each of the eight measuring positions were measured using method of Johnson-Saltykov (see "QUANTITATIVE MICROSCOPY", Uchida Rokakuho, published at Jul. 30, 1972, R. T. DeHoff and F. N. Rhines, p 189). Then, the average values of the grain size of the bcc phase in the surface layer areas 13 were obtained by further averaging the average values of the grain size of the bcc phase in each of the eight measuring positions.

The average values of the grain size of the bcc phase in the center areas 14 of the steel bars 1 were measured as follows. At first, average values of the grain size of the bcc phase in each of 9 measuring positions consisting of four measuring positions in portions 18 of which the depth were 50% of the radius r from the surfaces 15 of the steel bars 1, four measuring positions in portions 19 of which the depth were 75% of the radius r from the surfaces 15 of the steel bars 1, and one measuring position in the center 12 of the cross sections 10 of the steel bars 1 were measured using above-described method. Then, the average values of the grain size of the bcc phase in the center area 14 were obtained by further averaging the average values of the grain size of the bcc phase in each of the 9 measuring positions. four measuring positions were selected so that the angles between adjacent lines which were between the four measuring positions and the centers 12 of the cross sections 10 of the steel bars 1 were about 90 degrees. The four measuring positions in the portions 17 of which the depth were 25% of the radius r from the surfaces 10 of the steel bars 1, the four measuring positions in the portions 18 of which the depth were 50% of the radius r from the surfaces 10 of the steel bars 1, and the four measuring positions in the portions 19 of which the depth were 75% of the radius r from the surfaces 10 of the steel bars 1 were selected similarly.

(Induction Hardening)

Induction hardening was performed under a condition in which frequency was 300 kHz and heating time was 1.8 sec, and tempering was performed under a condition in which heating temperature was 170° C. and heating time was 1 hour. The hardness of surfaces of the steel bars after the induction hardening were minimum values of 8 measured values obtained by measuring at 8 positions in the cut sections (cross sections 10) perpendicular to the longitudinal direction of the steel bars 1, of which depth were 50 μm from the surfaces of the steel bars, with a micro-Vickers hardness tester of which load was 200 g. Above-described 8 positions were uniformly distributed along peripheries of the steel bars. That is, the angles between adjacent lines which were between the 8 positions and the centers of the steel bars 1 were about 45 degree. Samples having a hardness of less than Hv700 after the induction hardening were determined as "fail" regarding induction hardenability. "HARDNESS AFTER INDUCTION HARDENING" shown in Tables 2-4 to 2-6 indicates the hardness of the surfaces of the steel bars after the induction hardening.

(Three-Point Bend)

Three-point bend test pieces were manufactured by induction hardening the steel bars 1 having φ35 mm under the above-described condition, grinding the surfaces 15 to depth of 0.5 mm from the surfaces 15, and working U-notch having depth of 1 mm at surfaces after the grinding. Then, a three-point bend test was performed on the three-point bend test pieces in ethyl alcohol cooled to −40° C. under JIS Z 2248 "METALLIC MATERIALS—BEND TEST". The type of the test pieces was No. 2 test piece. Bending was performed by lowering a punch with velocity of 10 mm/min. In addition, the bending was performed until bend angle of the test pieces is 150 degree. The test pieces in which breaking occurred during the three-point bend test were determined as "fail".

(Impact Value)

Test piece materials having height of 10 mm, width of 10 mm, and a length of 55 mm were cut off from centers of the cross sections 10 of the steel bars 1. U-notches having a depth of 2 mm were formed in the test piece materials to manufacture U-notch charpy impact test pieces. Charpy impact test at −40° C. was performed on the U-notch charpy impact test pieces in accordance with JIS Z 2242 "METHOD FOR CHARPY PENDULUM IMPACT TEST OF METALLIC MATERIALS", and test pieces of which absorbed energy in the Charpy impact test were less than 90 J/cm$^2$ were determined as "fail".

As shown in Table 3, inventive examples were excellent in unevenness of hardening depth, fracture morphology, which indicates crack propagation stopping properties, in the three-point bend test, and impact value in comparison with comparative examples of which the amount of C was same thereto, as well as there was no problem in hardness after the induction hardening.

In comparative example No. 21, amount of C was lower than the defined range, and thus, the surface layer hardness after reheating was low, the hardness after induction hardening was low, and induction hardenability was poor.

In comparative examples 22 to 30, the finish rolling temperature was higher than the defined range, and thus, the average values of the grain size of the bcc phase in the surface layer areas and the center areas exceeded the defined range. In addition, in comparative examples 22 to 30, the crack propagation formed at the bottom of the notch did not stop, and breaking occurred during the three-point bend test. Furthermore, the impact values of the comparative examples No. 22 to 30 were low.

In comparative examples 31 to 39, the flow velocity of cooling water was high, the comparative examples 31 to 39 were excessively cooled, and reheating temperature was low. Thus, the surface hardness after reheating of the comparative examples 31 to 39 was higher than the defined range, and workability was poor.

In comparative examples 40 to 48, heating temperature before hot-rolling was high, heating time before the hot-rolling was long, and the finish rolling temperature was low. In the comparative examples 40 to 48, total decarburized layer thickness exceeded the defined range, the hardness after the induction hardening was low, and the induction hardenability was poor.

In comparative examples No. 49 to 57, the finish rolling temperature was lower than the defined range and the flow velocity of the cooling water after the hot-rolling was slow, and thus, the reheating temperature exceeded the defined range. In the comparative examples 49 to 57, area ratio of ferrite excessed the defined range, and thus, quenching was incompletely performed. Therefore, the grain size of bcc phase in surface layer areas and center areas thereof coarsened, crack propagation formed at the bottom of the notch did not stop and breaking occurred, impact values thereof were low, and base material toughness thereof were low. In addition, maximum quenching deflection in the cross section, Δmax, and Δmin therein, which indicated unevenness of hardening depth, exceeded the defined ranges, and thus, the amount of warpage was large and productivity was deteriorated.

In comparative examples No. 58 to 66, water film thickness with respect to the diameter of the steel bars were thin, and thus, Δmax, and Δmin therein, which indicated an unevenness of hardening depth, exceeded the defined ranges, the amount of warpage was large, and productivity was deteriorated.

[Table 1-1]
[Table 1-2]
[Table 1-3]
[Table 2-1]
[Table 2-2]
[Table 2-3]
[Table 2-4]
[Table 2-5]
[Table 2-6]

REFERENCE SIGNS LIST

1: Steel bar
10: Cross section
11: Periphery
12: Center
13: Surface layer area
14: Center area
15: Surface
16: Portion of which the depth is 200 μm
17: Portion of which the depth is 25% of the radius
18: Portion of which the depth is 50% of the radius
19: Portion of which the depth is 75% of the radius
101: Hardening region
102: Maximum hardening depth of cross section
103: Minimum hardening depth of cross section
104: Quenching deflection in cross section
105: Region of which a depth from the surface is 50 μm
$C_1$, $C_2$, and $C_3$: Cross section observation positions
20: Hot-rolled steel
21: Heating furnace
22: Hot-rolling mill
23: Infrared thermometer for measuring finish rolling temperature
24: Water cooling apparatus
25: Infrared thermometer for measuring water cooling temperature
26: Infrared thermometer for measuring reheating temperature
27: Cooling bed
28: Water cooling pipe
29: Cooling water

281: Passing direction of cooling water
282: Passing direction of hot-rolled steel
283: Water film thickness

31: Finish temperature
32: Water cooling temperature
33: Reheating temperature

TABLE 1-1

| TEST | | CHEMICAL COMPOSITION (mass %) | | | | | | | |
|---|---|---|---|---|---|---|---|---|---|
| No. | TYPE | C | Si | Mn | P | S | Al | N | OTHERS |
| 1 | INVENTIVE EXAMPLE | 0.45 | 0.20 | 0.85 | 0.010 | 0.045 | 0.025 | 0.0050 | |
| 2 | | 0.30 | 0.20 | 0.85 | 0.010 | 0.045 | 0.025 | 0.0050 | |
| 3 | | 0.75 | 0.20 | 0.86 | 0.012 | 0.001 | 0.026 | 0.0045 | |
| 4 | | 0.43 | 0.21 | 0.77 | 0.009 | 0.033 | 0.025 | 0.0051 | Cr: 0.12 |
| 5 | | 0.44 | 0.19 | 0.77 | 0.009 | 0.039 | 0.025 | 0.0067 | Cr: 0.12, Mo: 0.12 |
| 6 | | 0.45 | 0.26 | 0.77 | 0.009 | 0.040 | 0.026 | 0.0041 | Cu: 0.3, Ni: 0.3 |
| 7 | | 0.45 | 0.23 | 0.77 | 0.009 | 0.041 | 0.026 | 0.0052 | B: 0.0025, Ti: 0.03 |
| 8 | | 0.46 | 0.23 | 0.77 | 0.009 | 0.043 | 0.021 | 0.0075 | Ca: 0.001 |
| 9 | | 0.46 | 0.21 | 0.77 | 0.009 | 0.043 | 0.026 | 0.0051 | Zr: 0.005, Rem: 0.0004 |
| 10 | | 0.44 | 0.20 | 0.55 | 0.004 | 0.045 | 0.023 | 0.0049 | Mg: 0.0005 |
| 11 | | 0.44 | 0.20 | 0.75 | 0.010 | 0.045 | 0.026 | 0.0051 | Nb: 0.03 |
| 12 | | 0.44 | 0.19 | 0.58 | 0.012 | 0.041 | 0.027 | 0.0052 | V: 0.09 |
| 13 | | 0.46 | 0.19 | 0.49 | 0.009 | 0.041 | 0.026 | 0.0055 | W: 0.03 |
| 14 | | 0.45 | 0.21 | 0.63 | 0.014 | 0.042 | 0.029 | 0.0051 | Sb: 0.0007 |
| 15 | | 0.46 | 0.20 | 0.78 | 0.018 | 0.046 | 0.026 | 0.0048 | Sn: 0.02 |
| 16 | | 0.43 | 0.23 | 0.74 | 0.010 | 0.047 | 0.027 | 0.0066 | Zn: 0.02 |
| 17 | | 0.43 | 0.21 | 0.53 | 0.014 | 0.043 | 0.026 | 0.0048 | Te: 0.0008 |
| 18 | | 0.45 | 0.20 | 0.75 | 0.012 | 0.042 | 0.025 | 0.0049 | Bi: 0.02 |
| 19 | | 0.45 | 0.20 | 0.64 | 0.013 | 0.044 | 0.026 | 0.0043 | Pb: 0.03 |
| 20 | | 0.45 | 0.20 | 0.58 | 0.013 | 0.045 | 0.025 | 0.0050 | Nb: 0.03, V: 0.09 |

TABLE 1-2

| TEST | | CHEMICAL COMPOSITION (mass %) | | | | | | | |
|---|---|---|---|---|---|---|---|---|---|
| No. | TYPE | C | Si | Mn | P | S | Al | N | OTHERS |
| 21 | COMPARATIVE EXAMPLE | 0.25 | 0.20 | 0.85 | 0.010 | 0.045 | 0.025 | 0.0050 | |
| 22 | | 0.45 | 0.20 | 0.58 | 0.013 | 0.045 | 0.025 | 0.0050 | |
| 23 | | 0.43 | 0.21 | 0.77 | 0.009 | 0.033 | 0.025 | 0.0051 | Cr: 0.12 |
| 24 | | 0.44 | 0.19 | 0.77 | 0.009 | 0.039 | 0.025 | 0.0067 | Cr: 0.12, Mo: 0.12 |
| 25 | | 0.45 | 0.23 | 0.77 | 0.009 | 0.041 | 0.026 | 0.0052 | B: 0.0025, Ti: 0.03 |
| 26 | | 0.46 | 0.21 | 0.77 | 0.009 | 0.043 | 0.026 | 0.0051 | Zr: 0.005, Rem: 0.0004 |
| 27 | | 0.44 | 0.19 | 0.58 | 0.012 | 0.041 | 0.027 | 0.0052 | V: 0.09 |
| 28 | | 0.46 | 0.19 | 0.49 | 0.009 | 0.041 | 0.026 | 0.0055 | W: 0.03 |
| 29 | | 0.45 | 0.20 | 0.64 | 0.013 | 0.044 | 0.026 | 0.0043 | Pb: 0.03 |
| 30 | | 0.45 | 0.20 | 0.58 | 0.013 | 0.045 | 0.025 | 0.0050 | Nb: 0.03, V: 0.09 |
| 31 | | 0.45 | 0.20 | 0.58 | 0.013 | 0.045 | 0.025 | 0.0050 | |
| 32 | | 0.43 | 0.21 | 0.77 | 0.009 | 0.033 | 0.025 | 0.0051 | Cr: 0.12 |
| 33 | | 0.44 | 0.19 | 0.77 | 0.009 | 0.039 | 0.025 | 0.0067 | Cr: 0.12, Mo: 0.12 |
| 34 | | 0.45 | 0.23 | 0.77 | 0.009 | 0.041 | 0.026 | 0.0052 | B: 0.0025, Ti: 0.03 |
| 35 | | 0.46 | 0.21 | 0.77 | 0.009 | 0.043 | 0.026 | 0.0051 | Zr: 0.005, Rem: 0.0004 |
| 36 | | 0.44 | 0.19 | 0.58 | 0.012 | 0.041 | 0.027 | 0.0052 | V: 0.09 |
| 37 | | 0.46 | 0.19 | 0.49 | 0.009 | 0.041 | 0.026 | 0.0055 | W: 0.03 |
| 38 | | 0.45 | 0.20 | 0.64 | 0.013 | 0.044 | 0.026 | 0.0043 | Pb: 0.03 |
| 39 | | 0.45 | 0.20 | 0.58 | 0.013 | 0.045 | 0.025 | 0.0050 | Nb: 0.03, V: 0.09 |
| 40 | | 0.45 | 0.20 | 0.58 | 0.013 | 0.045 | 0.025 | 0.0050 | |
| 41 | | 0.43 | 0.21 | 0.77 | 0.009 | 0.033 | 0.025 | 0.0051 | Cr: 0.12 |

TABLE 1-3

| TEST | | CHEMICAL COMPOSITION (mass %) | | | | | | | |
|---|---|---|---|---|---|---|---|---|---|
| No. | TYPE | C | Si | Mn | P | S | Al | N | OTHERS |
| 42 | COMPARATIVE EXAMPLE | 0.44 | 0.19 | 0.77 | 0.009 | 0.039 | 0.025 | 0.0067 | Cr: 0.12, Mo: 0.12 |
| 43 | | 0.45 | 0.23 | 0.77 | 0.009 | 0.041 | 0.026 | 0.0052 | B: 0.0025, Ti: 0.03 |
| 44 | | 0.46 | 0.21 | 0.77 | 0.009 | 0.043 | 0.026 | 0.0051 | Zr: 0.005, Rem: 0.0004 |
| 45 | | 0.44 | 0.19 | 0.58 | 0.012 | 0.041 | 0.027 | 0.0052 | V: 0.09 |
| 46 | | 0.46 | 0.19 | 0.49 | 0.009 | 0.041 | 0.026 | 0.0055 | W: 0.03 |
| 47 | | 0.45 | 0.20 | 0.64 | 0.013 | 0.044 | 0.026 | 0.0043 | Pb: 0.03 |
| 48 | | 0.45 | 0.20 | 0.58 | 0.013 | 0.045 | 0.025 | 0.0050 | Nb: 0.03, V: 0.09 |
| 49 | | 0.45 | 0.20 | 0.58 | 0.013 | 0.045 | 0.025 | 0.0050 | |
| 50 | | 0.43 | 0.21 | 0.77 | 0.009 | 0.033 | 0.025 | 0.0051 | Cr: 0.12 |
| 51 | | 0.44 | 0.19 | 0.77 | 0.009 | 0.039 | 0.025 | 0.0067 | Cr: 0.12, Mo: 0.12 |
| 52 | | 0.45 | 0.23 | 0.77 | 0.009 | 0.041 | 0.026 | 0.0052 | B: 0.0025, Ti: 0.03 |
| 53 | | 0.46 | 0.21 | 0.77 | 0.009 | 0.043 | 0.026 | 0.0051 | Zr: 0.005, Rem: 0.0004 |

TABLE 1-3-continued

| TEST No. | TYPE | CHEMICAL COMPOSITION (mass %) C | Si | Mn | P | S | Al | N | OTHERS |
|---|---|---|---|---|---|---|---|---|---|
| 54 | | 0.44 | 0.19 | 0.58 | 0.012 | 0.041 | 0.027 | 0.0052 | V: 0.09 |
| 55 | | 0.46 | 0.19 | 0.49 | 0.009 | 0.041 | 0.026 | 0.0055 | W: 0.03 |
| 56 | | 0.45 | 0.20 | 0.64 | 0.013 | 0.044 | 0.026 | 0.0043 | Pb: 0.03 |
| 57 | | 0.45 | 0.20 | 0.58 | 0.013 | 0.045 | 0.025 | 0.0050 | Nb: 0.03, V: 0.09 |
| 58 | | 0.45 | 0.20 | 0.58 | 0.013 | 0.045 | 0.025 | 0.0050 | |
| 59 | | 0.43 | 0.21 | 0.77 | 0.009 | 0.033 | 0.025 | 0.0051 | Cr: 0.12 |
| 60 | | 0.44 | 0.19 | 0.77 | 0.009 | 0.039 | 0.025 | 0.0067 | Cr: 0.12, Mo: 0.12 |
| 61 | | 0.45 | 0.23 | 0.77 | 0.009 | 0.041 | 0.026 | 0.0052 | B: 0.0025, Ti: 0.03 |
| 62 | | 0.46 | 0.21 | 0.77 | 0.009 | 0.043 | 0.026 | 0.0051 | Zr: 0.005, Rem: 0.0004 |
| 63 | | 0.44 | 0.19 | 0.58 | 0.012 | 0.041 | 0.027 | 0.0052 | V: 0.09 |
| 64 | | 0.46 | 0.19 | 0.49 | 0.009 | 0.041 | 0.026 | 0.0055 | W: 0.03 |
| 65 | | 0.45 | 0.20 | 0.64 | 0.013 | 0.044 | 0.026 | 0.0043 | Pb: 0.03 |
| 66 | | 0.45 | 0.20 | 0.58 | 0.013 | 0.045 | 0.025 | 0.0050 | Nb: 0.03, V: 0.09 |

TABLE 2-1

| TEST No. | TYPE | MANUFACTURING CONDITION DIA. mm | HEATING TEMP. ° C. | HEATING TIME min | FINISH ROLLING TEMP. ° C. | WATER FILM THICKNESS/ DIA. OF STEEL | LENGTH OF WATER COOLING ZONE m | SPEED PASSING WATER COOLING ZONE m/s | FLOW VELOCITY m/s | REHEATING TEMP. ° C. |
|---|---|---|---|---|---|---|---|---|---|---|
| 1 | INVENTIVE EXAMPLE | 35 | 1175 | 109 | 910 | 0.40 | 20 | 4 | 0.7 | 595 |
| 2 | | 35 | 1181 | 108 | 922 | 0.40 | 20 | 4 | 1.2 | 520 |
| 3 | | 35 | 1178 | 108 | 923 | 0.40 | 20 | 4 | 1.1 | 523 |
| 4 | | 35 | 1175 | 107 | 924 | 0.13 | 20 | 4 | 1.1 | 521 |
| 5 | | 35 | 1186 | 111 | 922 | 0.40 | 20 | 4 | 1.2 | 522 |
| 6 | | 35 | 1185 | 112 | 918 | 0.40 | 20 | 4 | 1.3 | 520 |
| 7 | | 35 | 1172 | 109 | 919 | 0.40 | 20 | 4 | 1.2 | 520 |
| 8 | | 35 | 1171 | 120 | 919 | 0.40 | 20 | 4 | 1.2 | 524 |
| 9 | | 35 | 1173 | 121 | 923 | 0.40 | 20 | 4 | 1.1 | 519 |
| 10 | | 35 | 1176 | 112 | 922 | 0.20 | 20 | 4 | 1.3 | 518 |
| 11 | | 35 | 1178 | 109 | 922 | 0.40 | 20 | 4 | 1.1 | 521 |
| 12 | | 35 | 1175 | 109 | 920 | 0.40 | 20 | 4 | 1.2 | 519 |
| 13 | | 35 | 1175 | 112 | 924 | 0.40 | 20 | 4 | 1.3 | 519 |
| 14 | | 35 | 1162 | 107 | 918 | 0.40 | 20 | 4 | 1.3 | 523 |
| 15 | | 35 | 1175 | 108 | 919 | 0.40 | 20 | 4 | 1.2 | 522 |
| 16 | | 35 | 1174 | 112 | 918 | 0.20 | 20 | 4 | 1.1 | 522 |
| 17 | | 35 | 1178 | 123 | 918 | 0.40 | 20 | 4 | 1.2 | 518 |
| 18 | | 35 | 1178 | 122 | 918 | 0.40 | 20 | 4 | 1.3 | 517 |
| 19 | | 35 | 1176 | 123 | 921 | 0.40 | 20 | 4 | 1.1 | 521 |
| 20 | | 35 | 1145 | 122 | 919 | 0.40 | 20 | 4 | 1.2 | 522 |

TABLE 2-2

| TEST No. | TYPE | MANUFACTURING CONDITION DIA. mm | HEATING TEMP. ° C. | HEATING TIME min | FINISH ROLLING TEMP. ° C. | WATER FILM THICKNESS/ DIA. OF STEEL | LENGTH OF WATER COOLING ZONE m | SPEED PASSING WATER COOLING ZONE m/s | FLOW VELOCITY m/s | REHEATING TEMP. ° C. |
|---|---|---|---|---|---|---|---|---|---|---|
| 21 | COMPARATIVE EXAMPLE | 35 | 1175 | 108 | 912 | 0.40 | 20 | 4 | 0.7 | 595 |
| 22 | | 35 | 1178 | 121 | 1021 | 0.40 | 20 | 4 | 0.4 | 597 |
| 23 | | 35 | 1177 | 121 | 1020 | 0.40 | 20 | 4 | 1.2 | 520 |
| 24 | | 35 | 1176 | 120 | 1019 | 0.40 | 20 | 4 | 1.1 | 521 |
| 25 | | 35 | 1178 | 121 | 1022 | 0.40 | 20 | 4 | 1.2 | 522 |
| 26 | | 35 | 1179 | 121 | 1021 | 0.40 | 20 | 4 | 1.2 | 520 |
| 27 | | 35 | 1180 | 120 | 1021 | 0.40 | 20 | 4 | 1.1 | 520 |
| 28 | | 35 | 1178 | 121 | 1020 | 0.40 | 20 | 4 | 1.3 | 521 |
| 29 | | 35 | 1178 | 121 | 1020 | 0.40 | 20 | 4 | 1.1 | 522 |
| 30 | | 35 | 1177 | 121 | 1021 | 0.40 | 20 | 4 | 1.1 | 522 |
| 31 | | 35 | 1173 | 122 | 950 | 0.40 | 20 | 4 | 2.2 | 381 |
| 32 | | 35 | 1172 | 121 | 948 | 0.40 | 20 | 4 | 2.1 | 383 |
| 33 | | 35 | 1172 | 122 | 949 | 0.40 | 20 | 4 | 2.2 | 381 |
| 34 | | 35 | 1172 | 120 | 949 | 0.40 | 20 | 4 | 2.3 | 378 |

TABLE 2-2-continued

| TEST No. | TYPE | MANUFACTURING CONDITION DIA. mm | HEATING TEMP. ° C. | HEATING TIME min | FINISH ROLLING TEMP. ° C. | WATER FILM THICKNESS/ DIA. OF STEEL | LENGTH OF WATER COOLING ZONE m | SPEED PASSING WATER COOLING ZONE m/s | FLOW VELOCITY m/s | REHEATING TEMP. ° C. |
|---|---|---|---|---|---|---|---|---|---|---|
| 35 | | 35 | 1172 | 120 | 953 | 0.40 | 20 | 4 | 2.2 | 380 |
| 36 | | 35 | 1173 | 121 | 951 | 0.40 | 20 | 4 | 2.2 | 382 |
| 37 | | 35 | 1171 | 122 | 952 | 0.40 | 20 | 4 | 2.3 | 380 |
| 38 | | 35 | 1173 | 121 | 953 | 0.40 | 20 | 4 | 2.1 | 382 |
| 39 | | 35 | 1173 | 121 | 952 | 0.40 | 20 | 4 | 2.2 | 382 |
| 40 | | 35 | 1230 | 151 | 820 | 0.40 | 20 | 4 | 1.9 | 412 |
| 41 | | 35 | 1231 | 152 | 825 | 0.40 | 20 | 4 | 1.8 | 420 |

TABLE 2-3

| TEST No. | TYPE | MANUFACTURING CONDITION DIA. mm | HEATING TEMP. ° C. | HEATING TIME min | FINISH ROLLING TEMP. ° C. | WATER FILM THICKNESS/ DIA. OF STEEL | LENGTH OF WATER COOLING ZONE m | SPEED PASSING WATER COOLING ZONE m/s | FLOW VELOCITY m/s | REHEATING TEMP. ° C. |
|---|---|---|---|---|---|---|---|---|---|---|
| 42 | COMPARATIVE EXAMPLE | 35 | 1229 | 151 | 823 | 0.40 | 20 | 4 | 1.8 | 420 |
| 43 | | 35 | 1229 | 153 | 827 | 0.40 | 20 | 4 | 1.7 | 423 |
| 44 | | 35 | 1230 | 154 | 823 | 0.40 | 20 | 4 | 1.7 | 421 |
| 45 | | 35 | 1231 | 152 | 827 | 0.40 | 20 | 4 | 1.6 | 423 |
| 46 | | 35 | 1229 | 152 | 825 | 0.40 | 20 | 4 | 1.8 | 420 |
| 47 | | 35 | 1229 | 153 | 826 | 0.40 | 20 | 4 | 1.8 | 421 |
| 48 | | 35 | 1230 | 152 | 824 | 0.40 | 20 | 4 | 1.9 | 423 |
| 49 | | 35 | 1173 | 120 | 812 | 0.40 | 20 | 4 | 0.3 | 609 |
| 50 | | 35 | 1165 | 121 | 815 | 0.40 | 20 | 4 | 0.2 | 610 |
| 51 | | 35 | 1163 | 123 | 814 | 0.40 | 20 | 4 | 0.2 | 611 |
| 52 | | 35 | 1165 | 121 | 816 | 0.40 | 20 | 4 | 0.3 | 605 |
| 53 | | 35 | 1164 | 120 | 815 | 0.40 | 20 | 4 | 0.3 | 610 |
| 54 | | 35 | 1163 | 121 | 816 | 0.40 | 20 | 4 | 0.2 | 607 |
| 55 | | 35 | 1163 | 121 | 814 | 0.40 | 20 | 4 | 0.2 | 607 |
| 56 | | 35 | 1164 | 120 | 816 | 0.40 | 20 | 4 | 0.3 | 608 |
| 57 | | 35 | 1166 | 120 | 815 | 0.40 | 20 | 4 | 0.3 | 609 |
| 58 | | 35 | 1176 | 110 | 911 | 0.09 | 20 | 4 | 0.6 | 596 |
| 59 | | 35 | 1170 | 113 | 915 | 0.09 | 20 | 4 | 0.8 | 589 |
| 60 | | 35 | 1169 | 111 | 920 | 0.09 | 20 | 4 | 0.9 | 591 |
| 61 | | 35 | 1167 | 112 | 913 | 0.09 | 20 | 4 | 0.7 | 592 |
| 62 | | 35 | 1166 | 113 | 914 | 0.09 | 20 | 4 | 0.7 | 595 |
| 63 | | 35 | 1165 | 111 | 916 | 0.09 | 20 | 4 | 0.8 | 592 |
| 64 | | 35 | 1163 | 112 | 912 | 0.09 | 20 | 4 | 0.9 | 593 |
| 65 | | 35 | 1167 | 112 | 910 | 0.09 | 20 | 4 | 0.8 | 596 |
| 66 | | 35 | 1164 | 114 | 920 | 0.09 | 20 | 4 | 0.7 | 595 |

TABLE 2-4

| Test No. | TYPE | PROPERTIES OF STEEL CURVE mm/m | DM-T mm | AREA RATIO OF FERRITE IN SURFACE LAYER AREA % | SURFACE LAYER HARDNESS AFTER REHEATING HV | UNEVENNESS OF HARDENING DEPTH MAX ⊿c mm | ⊿max mm | ⊿min mm |
|---|---|---|---|---|---|---|---|---|
| 1 | INVENTIVE EXAMPLE | 2.4 | 0.08 | 0 | 242 | 1.1 | 1.1 | 1.0 |
| 2 | | 2.7 | 0.08 | 0 | 290 | 1.1 | 1.2 | 1.1 |
| 3 | | 2.4 | 0.08 | 0 | 320 | 1.2 | 1.2 | 1.2 |
| 4 | | 2.9 | 0.09 | 0 | 273 | 1.2 | 1.0 | 1.1 |
| 5 | | 2.4 | 0.07 | 0 | 274 | 1.0 | 0.7 | 1.1 |
| 6 | | 2.5 | 0.11 | 0 | 275 | 1.1 | 1.2 | 1.3 |
| 7 | | 2.4 | 0.09 | 0 | 275 | 1.3 | 1.2 | 1.2 |
| 8 | | 2.4 | 0.08 | 0 | 275 | 0.9 | 1.3 | 1.1 |
| 9 | | 2.2 | 0.08 | 0 | 269 | 1.1 | 1.0 | 0.9 |
| 10 | | 2.6 | 0.10 | 0 | 250 | 1.1 | 1.2 | 1.0 |

TABLE 2-4-continued

| | | | | | | | |
|---|---|---|---|---|---|---|---|
| 11 | 2.1 | 0.07 | 0 | 264 | 1.2 | 1.1 | 1.1 |
| 12 | 2.1 | 0.09 | 0 | 250 | 0.9 | 1.1 | 1.2 |
| 13 | 2.4 | 0.09 | 0 | 289 | 1.0 | 1.2 | 1.3 |
| 14 | 2.4 | 0.08 | 0 | 270 | 0.8 | 1.0 | 1.0 |
| 15 | 2.3 | 0.08 | 0 | 291 | 1.2 | 1.1 | 1.2 |
| 16 | 2.5 | 0.10 | 0 | 266 | 1.1 | 1.2 | 1.1 |
| 17 | 2.3 | 0.08 | 0 | 275 | 1.1 | 1.1 | 1.1 |
| 18 | 2.5 | 0.09 | 0 | 283 | 1.3 | 0.9 | 1.3 |
| 19 | 2.1 | 0.06 | 0 | 279 | 0.8 | 0.9 | 1.0 |
| 20 | 2.2 | 0.07 | 0 | 280 | 0.9 | 0.9 | 1.1 |

| | | PROPERTIES OF STEEL | | | | |
|---|---|---|---|---|---|---|
| Test No. | TYPE | AVERAGE DIA. OF bcc IN SURFACE LAYER AREA μm | AVERAGE DIA. OF bcc IN CENTER AREA μm | IMPACT VALUE (−40° C.) J/cm$^2$ | RESULT OF THREE-POINT BEND TEST (−40° C.) | HARDNESS AFTER INDUCTION HARDENING HV |
| 1 | INVENTIVE EXAMPLE | 5.7 | 12.5 | 103 | UNBLOKEN | 712 |
| 2 | | 5.7 | 13.4 | 115 | UNBLOKEN | 702 |
| 3 | | 5.4 | 13.4 | 91 | UNBLOKEN | 725 |
| 4 | | 5.3 | 13.2 | 101 | UNBLOKEN | 711 |
| 5 | | 5.3 | 12.9 | 105 | UNBLOKEN | 712 |
| 6 | | 5.6 | 12.7 | 112 | UNBLOKEN | 709 |
| 7 | | 5.7 | 12.6 | 106 | UNBLOKEN | 709 |
| 8 | | 5.6 | 13.1 | 104 | UNBLOKEN | 714 |
| 9 | | 5.2 | 13.0 | 101 | UNBLOKEN | 715 |
| 10 | | 5.2 | 13.2 | 123 | UNBLOKEN | 712 |
| 11 | | 5.4 | 13.2 | 106 | UNBLOKEN | 713 |
| 12 | | 5.6 | 13.5 | 126 | UNBLOKEN | 711 |
| 13 | | 5.5 | 12.9 | 102 | UNBLOKEN | 711 |
| 14 | | 5.6 | 12.9 | 114 | UNBLOKEN | 714 |
| 15 | | 5.3 | 13.0 | 106 | UNBLOKEN | 713 |
| 16 | | 5.2 | 13.1 | 116 | UNBLOKEN | 712 |
| 17 | | 5.2 | 12.8 | 110 | UNBLOKEN | 711 |
| 18 | | 5.1 | 13.6 | 111 | UNBLOKEN | 710 |
| 19 | | 5.4 | 12.4 | 110 | UNBLOKEN | 715 |
| 20 | | 5.3 | 12.3 | 110 | UNBLOKEN | 714 |

TABLE 2-5

| | | PROPERTIES OF STEEL | | | | | | |
|---|---|---|---|---|---|---|---|---|
| | | | | AREA RATIO OF FERRITE IN SURFACE | SURFACE LAYER HARDNESS AFTER | UNEVENNESS OF HARDENING DEPTH | | |
| Test No. | TYPE | CURVE mm/m | DM-T mm | LAYER AREA % | REHEATING HV | MAX ⊿c mm | ⊿max mm | ⊿min mm |
| 21 | COMPARATIVE EXAMPLE | 2.4 | 0.08 | 0 | 167 | 1.1 | 1.1 | 1.0 |
| 22 | | 2.4 | 0.08 | 2 | 261 | 0.9 | 1.2 | 1.1 |
| 23 | | 2.3 | 0.05 | 0 | 260 | 1.1 | 1.3 | 1.1 |
| 24 | | 2.4 | 0.08 | 0 | 262 | 1.0 | 1.2 | 1.2 |
| 25 | | 2.3 | 0.07 | 0 | 263 | 1.2 | 1.3 | 1.3 |
| 26 | | 2.3 | 0.06 | 0 | 259 | 1.2 | 1.3 | 1.2 |
| 27 | | 2.5 | 0.06 | 0 | 259 | 1.1 | 1.2 | 1.1 |
| 28 | | 2.3 | 0.05 | 0 | 260 | 1.3 | 1.1 | 1.2 |
| 29 | | 2.2 | 0.07 | 0 | 260 | 1.0 | 1.2 | 1.2 |
| 30 | | 2.3 | 0.08 | 0 | 262 | 1.1 | 1.1 | 1.2 |
| 31 | | 2.1 | 0.09 | 0 | 513 | 0.9 | 1.0 | 1.3 |
| 32 | | 1.9 | 0.10 | 0 | 515 | 1.0 | 1.0 | 1.1 |
| 33 | | 2.0 | 0.09 | 0 | 511 | 0.9 | 1.1 | 1.2 |
| 34 | | 2.1 | 0.08 | 0 | 513 | 1.1 | 1.0 | 1.1 |
| 35 | | 2.1 | 0.06 | 0 | 514 | 1.0 | 1.0 | 1.1 |
| 36 | | 1.9 | 0.05 | 0 | 514 | 1.0 | 1.1 | 1.1 |
| 37 | | 1.9 | 0.06 | 0 | 513 | 1.1 | 1.1 | 1.0 |
| 38 | | 1.8 | 0.06 | 0 | 512 | 1.0 | 1.0 | 1.2 |
| 39 | | 2.0 | 0.07 | 0 | 513 | 1.1 | 1.0 | 0.9 |
| 40 | | 2.1 | 0.24 | 0 | 395 | 1.2 | 1.1 | 1.3 |
| 41 | | 2.1 | 0.23 | 0 | 394 | 1.2 | 1.0 | 1.2 |

TABLE 2-5-continued

| Test No. | TYPE | PROPERTIES OF STEEL: AVERAGE DIA. OF bcc IN SURFACE LAYER AREA μm | AVERAGE DIA OF bcc IN CENTER AREA μm | IMPACT VALUE (−40° C.) J/cm² | RESULT OF THREE-POINT BEND TEST (−40° C.) | HARDNESS AFTER INDUCTION HARDENING HV |
|---|---|---|---|---|---|---|
| 21 | COMPARATIVE EXAMPLE | 5.7 | 12.5 | 103 | UNBLOKEN | 601 |
| 22 | | 10.5 | 15.6 | 78 | BLOKEN | 710 |
| 23 | | 10.4 | 16.1 | 79 | BLOKEN | 712 |
| 24 | | 10.3 | 16.0 | 79 | BLOKEN | 710 |
| 25 | | 10.1 | 15.1 | 79 | BLOKEN | 715 |
| 26 | | 10.3 | 16.3 | 77 | BLOKEN | 713 |
| 27 | | 10.5 | 15.5 | 75 | BLOKEN | 715 |
| 28 | | 10.5 | 15.6 | 76 | BLOKEN | 715 |
| 29 | | 10.6 | 16.2 | 72 | BLOKEN | 713 |
| 30 | | 10.4 | 16.2 | 78 | BLOKEN | 714 |
| 31 | | 8.8 | 13.5 | 102 | UNBLOKEN | 711 |
| 32 | | 8.9 | 13.2 | 105 | UNBLOKEN | 712 |
| 33 | | 9.3 | 13.1 | 107 | UNBLOKEN | 713 |
| 34 | | 8.1 | 11.2 | 115 | UNBLOKEN | 715 |
| 35 | | 9.1 | 13.6 | 105 | UNBLOKEN | 714 |
| 36 | | 8.8 | 13.2 | 103 | UNBLOKEN | 713 |
| 37 | | 8.9 | 13.1 | 103 | UNBLOKEN | 712 |
| 38 | | 8.7 | 13.5 | 104 | UNBLOKEN | 713 |
| 39 | | 8.8 | 13.4 | 105 | UNBLOKEN | 713 |
| 40 | | 5.1 | 9.1 | 119 | UNBLOKEN | 623 |
| 41 | | 4.7 | 9.2 | 120 | UNBLOKEN | 625 |

TABLE 2-6

| Test No. | TYPE | PROPERTIES OF STEEL: CURVE mm/m | DM-T mm | AREA RATIO OF FERRITE IN SURFACE LAYER AREA % | SURFACE LAYER HARDNESS AFTER REHEATING HV | UNEVENNESS OF HARDENING DEPTH: MAX ⊿c mm | ⊿max mm | ⊿min mm |
|---|---|---|---|---|---|---|---|---|
| 42 | COMPARATIVE EXAMPLE | 2.2 | 0.21 | 0 | 393 | 1.3 | 1.1 | 1.2 |
| 43 | | 2.1 | 0.22 | 0 | 394 | 1.2 | 1.2 | 1.3 |
| 44 | | 2.3 | 0.26 | 0 | 394 | 1.1 | 1.0 | 1.2 |
| 45 | | 2.1 | 0.23 | 0 | 393 | 1.1 | 1.1 | 1.1 |
| 46 | | 2.1 | 0.24 | 0 | 382 | 1.0 | 1.0 | 1.1 |
| 47 | | 2.0 | 0.25 | 0 | 393 | 1.2 | 1.1 | 1.0 |
| 48 | | 2.1 | 0.26 | 0 | 393 | 1.1 | 1.2 | 1.2 |
| 49 | | 3.3 | 0.15 | 13 | 245 | 1.6 | 1.7 | 1.8 |
| 50 | | 3.4 | 0.13 | 15 | 251 | 1.7 | 1.8 | 1.7 |
| 51 | | 3.2 | 0.12 | 13 | 250 | 1.6 | 1.7 | 1.8 |
| 52 | | 3.5 | 0.13 | 13 | 250 | 1.5 | 1.7 | 1.8 |
| 53 | | 3.2 | 0.13 | 12 | 251 | 1.7 | 1.8 | 1.7 |
| 54 | | 3.1 | 0.12 | 11 | 252 | 1.6 | 1.9 | 1.8 |
| 55 | | 3.2 | 0.14 | 12 | 249 | 1.6 | 1.9 | 1.8 |
| 56 | | 3.3 | 0.13 | 14 | 248 | 1.7 | 1.7 | 1.9 |
| 57 | | 3.3 | 0.14 | 12 | 249 | 1.7 | 1.8 | 1.7 |
| 58 | | 3.5 | 0.08 | 5 | 240 | 1.4 | 1.9 | 1.7 |
| 59 | | 3.5 | 0.08 | 6 | 241 | 1.5 | 1.9 | 1.7 |
| 60 | | 3.4 | 0.07 | 7 | 242 | 1.4 | 1.8 | 1.8 |
| 61 | | 3.1 | 0.09 | 2 | 240 | 1.3 | 1.8 | 1.9 |
| 62 | | 3.2 | 0.07 | 4 | 242 | 1.4 | 1.9 | 1.7 |
| 63 | | 3.5 | 0.06 | 6 | 243 | 1.5 | 1.7 | 1.8 |
| 64 | | 3.4 | 0.08 | 5 | 240 | 1.4 | 1.8 | 1.9 |
| 65 | | 3.3 | 0.09 | 6 | 241 | 1.5 | 1.9 | 1.8 |
| 66 | | 3.3 | 0.08 | 7 | 242 | 1.5 | 1.8 | 1.8 |

| Test No. | TYPE | PROPERTIES OF STEEL: AVERAGE DIA. OF bcc IN SURFACE LAYER AREA μm | AVERAGE DIA. OF bcc IN CENTER AREA μm | IMPACT VALUE (−40° C.) J/cm² | RESULT OF THREE-POINT BEND TEST (−40° C.) | HARDNESS AFTER INDUCTION HARDENING HV |
|---|---|---|---|---|---|---|
| 42 | COMPARATIVE EXAMPLE | 4.8 | 9.3 | 121 | UNBLOKEN | 620 |
| 43 | | 4.6 | 8.7 | 119 | UNBLOKEN | 624 |

TABLE 2-6-continued

| | | | | | |
|---|---|---|---|---|---|
| 44 | 4.8 | 9.2 | 120 | UNBLOKEN | 625 |
| 45 | 4.9 | 9.4 | 121 | UNBLOKEN | 623 |
| 46 | 4.7 | 9.5 | 118 | UNBLOKEN | 625 |
| 47 | 4.6 | 9.3 | 117 | UNBLOKEN | 624 |
| 48 | 4.5 | 9.4 | 120 | UNBLOKEN | 629 |
| 49 | 11.4 | 17.2 | 93 | BLOKEN | 710 |
| 50 | 11.3 | 17.3 | 92 | BLOKEN | 709 |
| 51 | 11.5 | 16.9 | 92 | BLOKEN | 711 |
| 52 | 10.4 | 15.2 | 95 | BLOKEN | 712 |
| 53 | 11.6 | 16.8 | 91 | BLOKEN | 708 |
| 54 | 11.2 | 17.1 | 90 | BLOKEN | 707 |
| 55 | 11.3 | 17.3 | 90 | BLOKEN | 710 |
| 56 | 11.4 | 17.2 | 91 | BLOKEN | 711 |
| 57 | 11.5 | 17.2 | 92 | BLOKEN | 712 |
| 58 | 9.1 | 13.2 | 103 | UNBLOKEN | 710 |
| 59 | 9.2 | 13.5 | 104 | UNBLOKEN | 712 |
| 60 | 9.6 | 13.5 | 105 | UNBLOKEN | 716 |
| 61 | 7.2 | 11.4 | 110 | UNBLOKEN | 712 |
| 62 | 9.6 | 13.2 | 105 | UNBLOKEN | 712 |
| 63 | 9.7 | 13.1 | 106 | UNBLOKEN | 713 |
| 64 | 9.8 | 13.6 | 107 | UNBLOKEN | 714 |
| 65 | 9.8 | 13.7 | 106 | UNBLOKEN | 712 |
| 66 | 9.7 | 13.8 | 106 | UNBLOKEN | 712 |

The invention claimed is:

1. A steel bar having a diameter of 19 to 120 mm, wherein the steel bar comprises, as a chemical composition in terms of mass %:

C: 0.30 to 0.80%;
Si: 0.01 to 1.50%;
Mn: 0.05 to 2.50%;
Al: 0.010 to 0.30%;
N: 0.0040 to 0.030%;
P: 0.035% or less;
S: 0.10% or less;
Cr: 0 to 3.0%;
Mo: 0 to 1.5%;
Cu: 0 to 2.0%;
Ni: 0 to 5.0%;
B: 0 to 0.0035%;
Ca: 0 to 0.0050%;
Zr: 0 to 0.0050%;
Mg: 0 to 0.0050%;
Rem: 0 to 0.0150%;
Ti: 0 to 0.150%;
Nb: 0 to 0.150%;
V: 0 to 1.0%;
W: 0 to 1.0%;
Sb: 0 to 0.0150%;
Sn: 0 to 2.0%;
Zn: 0 to 0.50%;
Te: 0 to 0.20%;
Bi: 0 to 0.50%;
Pb: 0 to 0.50%, and
a remainder including Fe and impurities, wherein a region which is along a line extending between a center of a cross section of the steel bar and a periphery of the cross section of the steel bar and which has a hardness higher than an average hardness in the line by Hv20 or more is a hardening region in the line, a minimum value of depth of the hardening regions in the 8 lines of which the angle is 45° is a minimum hardening depth in the cross section, and a maximum value of the depth of the hardening regions in the 8 lines is a maximum hardening depth in the cross section, wherein a difference between the maximum hardening depth in the cross section and the minimum hardening depth in the cross section is 1.5 mm or less, wherein, in a 3300 mm length of the steel bar, a difference between a maximum value of the maximum hardening depth and a minimum value of the maximum hardening depth in the cross sections at 3 points which are separated from each other by 1650 mm parallel to a longitudinal direction of the steel bar is 1.5 mm or less, wherein, in a 3300 mm length of the steel bar, a difference between a maximum value of the minimum hardening depth and a minimum value of the minimum hardening depth in the cross sections at the 3 points which are separated from each other by 1650 mm parallel to the longitudinal direction of the steel bar is 1.5 mm or less, wherein a structure in an area from a surface of the steel bar to a depth of 25% of a radius of the steel bar includes 10 area % or less of a ferrite and a remainder including one or more selected from a group consisting of a bainite and a martensite, wherein a boundary between grains which are adjacent to each other and of which an orientation difference is 15 degree or more is a grain boundary, and an equivalent circle diameter of an area surrounded by the grain boundary is a grain size, wherein an average value of the grain size of a bcc phase in the area from the surface of the steel bar to the depth of 25% of the radius of the steel bar is 1.0 to 10.0 μm, wherein an average value of the grain size of the bcc phase in an area from the depth of 50% of the radius of the steel bar to the center of the steel bar is 1.0 to 15.0 μm, wherein a hardness of a region of which a depth from the surface is 50 μm is Hv200 to Hv500, and wherein a total decarburized layer thickness DM-T is 0.20 mm or less.

2. The steel bar according to claim 1, comprising, as the chemical composition in terms of mass %:

one or more selected from the group consisting of

Cr: 0.1 to 3.0%;

Mo: 0.10 to 1.5%;

Cu: 0.10 to 2.0%;

Ni: 0.1 to 5.0%; and

B: 0.0010 to 0.0035%.

3. The steel bar according to claim 1, comprising, as the chemical composition in terms of mass %:
one or more selected from the group consisting of
Ca: 0.0001 to 0.0050%;
Zr: 0.0003 to 0.0050%;
Mg: 0.0003 to 0.0050%; and
Rem: 0.0001 to 0.0150%.

4. The steel bar according to claim 1, comprising, as the chemical composition in terms of mass %:
one or more selected from the group consisting of
Ti: 0.0030 to 0.0150%;
Nb: 0.004 to 0.150%;
V: 0.03 to 1.0%; and
W: 0.01 to 1.0%.

5. The steel bar according to claim 1, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

6. The steel bar according to claim 2, comprising, as the chemical composition in terms of mass %:
one or more selected from the group consisting of
Ca: 0.0001 to 0.0050%;
Zr: 0.0003 to 0.0050%;
Mg: 0.0003 to 0.0050%; and
Rem: 0.0001 to 0.0150%.

7. The steel bar according to claim 2, comprising, as the chemical composition in terms of mass %:
one or more selected from the group consisting of
Ti: 0.0030 to 0.0150%;
Nb: 0.004 to 0.150%;
V: 0.03 to 1.0%; and
W: 0.01 to 1.0%.

8. The steel bar according to claim 3, comprising, as the chemical composition in terms of mass %:
one or more selected from the group consisting of
Ti: 0.0030 to 0.0150%;
Nb: 0.004 to 0.150%;
V: 0.03 to 1.0%; and
W: 0.01 to 1.0%.

9. The steel bar according to claim 6, comprising, as the chemical composition in terms of mass %:
one or more selected from the group consisting of
Ti: 0.0030 to 0.0150%;
Nb: 0.004 to 0.150%;
V: 0.03 to 1.0%; and
W: 0.01 to 1.0%.

10. The steel bar according to claim 2, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

11. The steel bar according to claim 3, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

12. The steel bar according to claim 4, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

13. The steel bar according to claim 6, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

14. The steel bar according to claim 7, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

15. The steel bar according to claim 8, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

16. The steel bar according to claim 9, comprising, as the chemical composition in terms of mass %:
one or more selected from the group consisting of
Sb: 0.0005 to 0.0150%;
Sn: 0.005 to 2.0%;
Zn: 0.0005 to 0.50%;
Te: 0.0003 to 0.20%;
Bi: 0.005 to 0.50%; and
Pb: 0.005 to 0.50%.

* * * * *